US011624250B1

(12) United States Patent
Randall et al.

(10) Patent No.: US 11,624,250 B1
(45) Date of Patent: Apr. 11, 2023

(54) APPARATUS AND METHOD FOR RUNNING AND RETRIEVING TUBING USING AN ELECTRO-MECHANICAL LINEAR ACTUATOR DRIVEN DOWNHOLE TRACTOR

(71) Applicant: Coiled Tubing Specialties, LLC, Tulsa, OK (US)

(72) Inventors: Bruce L. Randall, Tulsa, OK (US); David P. Brisco, Duncan, OK (US); Bradford G. Randall, Tulsa, OK (US)

(73) Assignee: Coiled Tubing Specialties, LLC, Tulsa, OK (US)

( * ) Notice: Subject to any disclaimer, the term of this patent is extended or adjusted under 35 U.S.C. 154(b) by 0 days.

(21) Appl. No.: 17/339,496

(22) Filed: Jun. 4, 2021

(51) Int. Cl.

| | |
|---|---|
| ***E21B 23/00*** | (2006.01) |
| ***E21B 4/18*** | (2006.01) |
| ***E21B 23/14*** | (2006.01) |
| ***E21B 4/04*** | (2006.01) |

(52) U.S. Cl.
CPC ..... *E21B 23/001* (2020.05); *E21B 4/04* (2013.01); *E21B 4/18* (2013.01); *E21B 23/14* (2013.01)

(58) Field of Classification Search
CPC ..... E21B 4/04; E21B 4/18; E21B 23/001; E21B 23/14
See application file for complete search history.

(56) References Cited

U.S. PATENT DOCUMENTS

| | | | |
|---|---|---|---|
| 4,085,808 | A | 4/1978 | Kling |
| 4,256,179 | A | 3/1981 | Shillander |
| 5,291,975 | A | 3/1994 | Curlett |
| 5,413,184 | A | 5/1995 | Landers |
| 5,419,405 | A | 5/1995 | Patton |

(Continued)

FOREIGN PATENT DOCUMENTS

| | | |
|---|---|---|
| CN | 101660391 | 8/2008 |

OTHER PUBLICATIONS

S.D. Joshi, A Review of Horizontal Well and Drainhole Technology, SPE Paper No. 16,868; presented at the 62nd Annual Technical Conference (Sep. 1987).

(Continued)

*Primary Examiner* — Blake Michener
(74) *Attorney, Agent, or Firm* — Dennis D. Brown; Brown Patent Law, P.L.L.C.

(57) ABSTRACT

An electric motor-actuated tractor (e-Tractor) apparatus and method for use in downhole operations. The apparatus includes a power subassembly, a tractor subassembly and one or more gripper subassemblies and can be: run in a single or multiple e-Tractor configuration; run in either intermittent-motion tractoring mode or continuous-motion tractoring mode with the ability to switch between the two modes; used to generate both distal and proximal longitudinal forces to move the run-in string into or out of the wellbore; repeatedly activated and deactivated without run-in string manipulation or hydraulic pressure; and combined with tensiometer and other sensor package options to provide real-time data to the surface to optimize tractoring operations. The apparatus and method are well-suited for application in an c-coil conveyed workover or completion system, and for use in extended reach laterals in horizontal wells.

30 Claims, 4 Drawing Sheets

(56) References Cited

U.S. PATENT DOCUMENTS

| | | | | |
|---|---|---|---|---|
| 5,794,703 | A * | 8/1998 | Newman | E21B 23/00 166/381 |
| 5,853,056 | A | 12/1998 | Landers | |
| 5,954,131 | A | 9/1999 | Salwasser | |
| 6,003,606 | A | 12/1999 | Moore | |
| 6,125,949 | A | 10/2000 | Landers | |
| 6,263,984 | B1 | 7/2001 | Buckman, Sr. | |
| 6,283,230 | B1 | 9/2001 | Peters | |
| 6,378,629 | B1 | 4/2002 | Baird | |
| 6,412,578 | B1 | 7/2002 | Baird | |
| 6,419,020 | B1 | 7/2002 | Spingath | |
| 6,363,003 | B1 | 10/2002 | Bloom | |
| 6,467,557 | B1 | 10/2002 | Krueger | |
| 6,530,439 | B2 | 3/2003 | Mazorow | |
| 6,550,553 | B2 | 4/2003 | Baird | |
| 6,578,636 | B2 | 6/2003 | Mazorow et al. | |
| 6,629,568 | B2 | 10/2003 | Post | |
| 6,668,948 | B2 | 12/2003 | Buckman, Sr. et al. | |
| 6,889,781 | B2 | 5/2005 | Mazorow | |
| 6,915,853 | B2 | 7/2005 | Bakke et al. | |
| 6,964,303 | B2 | 11/2005 | Mazorow et al. | |
| 6,971,457 | B2 | 12/2005 | Baird | |
| 7,114,583 | B2 | 10/2006 | Chrisman | |
| 7,168,491 | B2 | 1/2007 | Malone et al. | |
| 7,185,716 | B2 | 3/2007 | Bloom | |
| 7,350,577 | B2 | 4/2008 | Watson | |
| 7,357,182 | B2 | 4/2008 | Hunt et al. | |
| 7,422,059 | B2 | 9/2008 | Jelsma | |
| 7,441,595 | B2 | 10/2008 | Jelsma | |
| 7,445,127 | B2 | 11/2008 | Schick | |
| 7,540,327 | B2 | 6/2009 | Billingham | |
| 7,669,672 | B2 | 3/2010 | Brunet et al. | |
| 7,686,101 | B2 | 3/2010 | Belew et al. | |
| 7,699,107 | B2 | 4/2010 | Butler et al. | |
| 7,886,834 | B2 | 2/2011 | Spencer et al. | |
| 7,971,658 | B2 | 7/2011 | Buckman, Sr. | |
| 8,028,766 | B2 | 10/2011 | Moore | |
| 8,074,744 | B2 | 12/2011 | Watson et al. | |
| 8,196,680 | B2 | 6/2012 | Buckman, Sr. et al. | |
| 8,245,796 | B2 | 8/2012 | Mock | |
| 8,267,198 | B2 | 9/2012 | Buckman, Sr. et al. | |
| 8,267,199 | B2 | 9/2012 | Buckman, Sr. et al. | |
| 8,752,651 | B2 | 6/2014 | Randall et al. | |
| 8,833,444 | B2 | 9/2014 | McAfee et al. | |
| 8,844,636 | B2 | 9/2014 | Bebak | |
| 8,991,522 | B2 | 3/2015 | Randall et al. | |
| 9,080,388 | B2 | 7/2015 | Heijnen | |
| 9,267,338 | B1 | 2/2016 | LeBlanc et al. | |
| 10,174,573 | B2 | 1/2019 | Bakke et al. | |
| 10,260,299 | B2 | 4/2019 | Randall | |
| 2002/0029908 | A1* | 3/2002 | Bloom | E21B 4/18 166/212 |
| 2002/0062993 | A1 | 5/2002 | Billingsley | |
| 2003/0108393 | A1 | 6/2003 | Coenen et al. | |
| 2003/0213590 | A1 | 11/2003 | Bakke et al. | |
| 2005/0173123 | A1 | 8/2005 | Lund et al. | |
| 2005/0279499 | A1 | 12/2005 | Tarvin et al. | |
| 2006/0180318 | A1* | 8/2006 | Doering | E21B 17/1021 166/207 |
| 2007/0151766 | A1 | 7/2007 | Butler et al. | |
| 2008/0308318 | A1* | 12/2008 | Moore | E21B 4/18 175/51 |
| 2009/0107678 | A1 | 4/2009 | Buckman, Sr. | |
| 2010/0243266 | A1 | 9/2010 | Soby et al. | |
| 2013/0284516 | A1 | 10/2013 | Prill et al. | |
| 2014/0102801 | A1 | 4/2014 | Hallendbauk et al. | |
| 2019/0345785 | A1* | 11/2019 | Fleckenstein | E21B 23/001 |

OTHER PUBLICATIONS

J.H Olsen, Abrasive Jet Mechanics, Te Fabricator Magazine (Mar. 2005 www.omax.com/images/files/abrasjvejet%20mechanics.pdf.

M. Kojic, et al., Analysis of the influence of Fluid Flow on Plasticity of Porous Rock Under an Axially Symmetric Punch, SPE Paper No. 4243 (Jun. 1974).

D A. Summers, et al., Can Nozzle Design Be Effectively Improved for Drilling Purposes, Energy Technology Conference, Houston, Texas (Nov. 1978).

*Carl Landers and Landers Horizontal Drill Inc* v *Sideways LLC,* United States Court of Appeals for the Federal Circuit, 04-1510, -1538 (Decided Jul. 27, 2005).

Carrell, et al. Report, Lateral Drilling and Completion Technologies for Shallow-Shelf Carbonates of the Red River and Ratcliffe Formations, Williston Basin (Jul. 1997).

W. Dickinson, et al., Data Acquisition Analysis and Control While Drilling With Horizontal Water Jet Drilling Systems, SPE Paper No. 90-127 (Jun. 1990).

A.W. Momber, Deformation and Fracture of Rocks Due to High Speed Liquicd Impingement, International J. of Fracture, pp. 683-704, Netherlands (Aug. 2044).

G.P. Tziallas, et al., Determination of Rock Strength and Deformability of Intact Rocks, EJGE vol. 14 (2009).

D. A. Summers, et al., Development of a Water Jet Drilling System, 4th International Symposium on Jet Cutting Technology, Canterbury, England (Apr. 1978).

D. A. Summers, Disintegration of Rock by High Pressure Jets, University of Leeds, Department of Applied Meneral Sciences, Ph.D. Dissertation (May 1968).

O. Katz, et al., Evaluation of Mechanical Rock Properties Using a Schmidt Hammer, International J. of Rock Mechanics, pp. 723-728 (2000).

D. A. Summers, Feasibility of Fluid Jet Based Drilling Methods for Drilling Through Unstable Formations, SPE Horizontal Well Technology Conference, Calgary, Alberta (Nov. 2002).

W.C. Maurer, et al., High Pressure Drilling, Journal of Petroleum Technology, pp. 851-859 (Jul. 1973).

W. Dickinson, et al., Horizontal Radial Drilling System, Society of Petroleum Engineers No. 13,949; California Regional Meeting, Bakersfield, California (Mar. 1985).

W.C. Maurer, et al., Hydraulic Jet Drilling, SPE Paper No. 2,434 (1969).

J.L. Pekarek, et al., Hydraulic Jetting: Some Theoretical and Experimental Results, SPE Paper No. 421, pp. 101-112 (Jun. 1963).

R. Kovaceviv, Hydraulic Process Parameters, SMU School of Engineering—Website Publication (accessed in 2012) http://lyle.smu.edu/.

D.A. Summers, et al., HyperVelocity Impact on Rock, AIME's Eleventh Symposium on Rock Mechanics, Berkely, California; Part VI—Chapter 32 (Jun. 1969).

F.C. Pittman, Investigation of Abrasive Laden Fluid Method for Perforation and Fracture Initiation, SPE Paper No. 1607-G; J. of Petroleum Technology, pp. 489-495 (May 1961).

P. Buset, A Jet Drilling Tool: Cost Effective Lateral Drilling Technology, SPE Paper No. 68,504; SPE/ICoTA Roundtable, Houston, Texas (Mar. 2001).

D.A. Summers, et al., Petroleum Applications of Emerging High Pressure Waterjet Technology, SPE Paper No. 26,347, Houston, Texas (Oct. 1993).

D.A. Summers, et al., Progress in Rock Drilling, Mechanical Engineering (Dec. 1989).

John H. Olson, Pumping Up the Waterjet Power, pp. 1-5 (Dec. 2007).

D.A. Summers, Recent Advances in the Use of High Pressure Waterjets in Drilling Applications, Advance Mining Technology Workshop, Colorado School of Mines (Oct. 1995).

R. Feenstra, et al., Rock Cutting by Jets A Promising Method of Oil Well Drilling, SPE Paper No. 4,923 (Sep. 1973).

W. Dickinson, et al., Slim Hole Multiple Radials Drilled with Coiled Tubing, SPE Paper No. 23,639; 2nd Latin American Petroleum Engineering Conference, Venzuela (Mar. 1992).

Smith Services, A Business Unit of Smith International, Inc., Smith International Inc. Trackmaster PLUS Wellbore Departure Systems, Houston, Texas (Apr. 2005).

D.A. Summers, The Application of Waterjets in a Stressed Rock Environment, Third Conference on Ground COntrol Problems in the Illinois Coal Basin (Aug. 1990).

(56) References Cited

OTHER PUBLICATIONS

P.C. Hagan, et al., The Cuttability of Rock Using a High Pressure Water Jet, School of Mining Engineering, The University of New South Wales (1990).
D.A. Summers, et al., The Effect of Change in Energy and Momentum Levels on the Rock Removal in Indiana Limestone, Symposium on Jet Cutting Technology, England (Apr. 1972).
D.A. Summers, et al., The Effect of Stress on Waterjet Performance, 19th Symposium on Rock Mechanics, Lake Tahoe, Nevada (May 1978).
D.A. Summers, et al., The Penetration of Rock by High Speed Water Jets, Int. J. Rock Mech. Min. Sci. vol. 6, pp. 249-258 Pergamon Press (1969).
U.S. Hose Corp., U.S. Hose Corporation Engineering Guide No. 350, Technical Specifications for U.S. Hose's Flexible Hoses, Romeoville, Illinois and Houston, Texas (2006).
D.A. Summers, et al., Water Jet Cutting of Sedimentary Rock, J. of Petroleum Technology, pp. 797-802 (Jul. 1972).
D.A. Summers, Water Jet Cutting Related to Jet and Rock Properties, 14th Symposium of Rock Mechanics, Penn State University, University Park, Pennsylvania (Jun. 1972).
D.A. Summers, et al., Water Jet Penetration into Rock (Nov. 1970).
D.A. Summers, Waterjet Applications Session Review, 5th Pacific Rim International Conference on Water Jet Technology, New Delhi, India (Feb. 1998).
Well Enhancement Services, LLC, Radial Jet Enhancement Brochure, The Woodlands, Texas (Jun. 2009).
Well Enhancement Services, LLC, Radial Jet Enhancement Brochure, The Woodlands, Texas (Jun. 2009) www.wellenhancement.com.
Halliburton, Hydra Jet Perforating Process Service (4-page brochure setting forth the Hydra-Jet Perforating Process Service (Sep. 2006) www.hlliburton.com.
TIW Corporation, Abrasive Jet Horizontal Drill, A Pearce Industries Company located in Houston, Texas; procedures for the TIW Abrasive Jet Horizontal Drill.
Vortech Oilfield Tools, LP, Vortech Oilfield Tools, www.Vortech-Inc.com; located in Midland, Texas; questions and answers about Vortech tools (publication date unknown).
S.J. Leach, et al., Application of High Speed Liquid Jets to Cutting; vol. 260, plate 60 (1996).
W.C. Cooley, Correlation of Data on Erosion and Breakage of Rock by High Pressure Water Jets; The 12th U.S. Symposium on Rock Mechanics, Missouri (Nov. 1970).
T.J. Labus, Energy Requirements for Rock Penetration by Water Jets; 3rd Int. Symposium on Jet Cutting Technology, BHRA Fluid Engineering, Cranfield, Bedford, England (1976).
D.A. Summers, et al., Water Jet Drilling in Sandstone and Granite; Proceedings from the 18th Symposium on Rock Mechanics, Keystone, Colorado (May 1997).
G.Rehbinder, A Theory About Cutting Rock With a Water Jet; J. of Rock Mechanics and Rock Engineering, vol. 12/3-12/4, (Mar. 1980).
W.C. Maurer, Advanced Drilling Techniques, pp. 229-301; Petroleum Publishing Company (1980).
M. Hashish, Experimental Studies of Cutting with Abrasive Waterjets; 2nd U.S. Waterjet Conference, University of Missouri-Rolla (May 1983).
Lm. Ford, Waterjet Assisted Mining Tools What Type Assistance and What Type Mining Machine?, Energy Citations Database (1983) Abstract Only.
J.J. Koelee, A Comparison of Water Jet Abrasive Jet and Rotary Diamond Drilling in Hard Rock; Tempress technologies, Oil and Gas Journal, vol. 96 (1999).
A.W. Momber, et al., An Energy Balance of High Speed Abrasive Water Jet Erosion; Institution of Mechnical Enineers, vol. 213 Part J; pp. 463-473 (Dec. 1998).
H Orbanic, et al., An Instrument for Measuring Abrasive WaterJet Diameter; International J. of Machine Tools & Manufacture, #49; pp. 843-849 (May 2009).
D.A. Summers, et al., Abrasive Jet Drilling: A New Technology; 30th U.S. Symposium on Rock Mechanics, Morgantown, West Virginia (Jun. 1989).
Michael J. Mayerhofer, Srv Proves Key in Shales for Correlating Stimulation and Well Performance; Oil & Gas Reporter, pp. 81-89 (Dec. 2010).
Buckman Jet Drilling presentation, ICoTA Lunch, Houston, Texas (Aug. 2013).
W. Dickinson, et al., Coiled-Tubing Radials Placed by Water-Jet Drilling, SPE Paper No. 26,348, Houston, Texas (Oct. 1993).
D.A. Summers et al., Comparison of Methods Available for the Determination of Surface Energy, 12th Symposium on Rock Mechanics, Univ. of Missouri-Rolla (Nov. 1970).
PCT International Application PCT/US2008/080631, Publication No. WO 2009/055381, Published Apr. 30, 2009.
PCT International Application PCT/US2018/056987, Publication No. WO 2019/083922, Published May 9, 2019.
SIPO Search Report dated Apr. 9, 2018 for Chinese Patent Application No. 2016800187458 (2 pages).

* cited by examiner

APPARATUS AND METHOD FOR RUNNING AND RETRIEVING TUBING USING AN ELECTRO-MECHANICAL LINEAR ACTUATOR DRIVEN DOWNHOLE TRACTOR

FIELD OF THE INVENTION

The present invention relates to downhole tubing tractoring apparatuses and methods and to downhole operations conducted using such apparatuses and methods.

BACKGROUND OF THE INVENTION

Advances in drilling technology have enabled oil and gas operators to economically "kick-off" and steer wellbore trajectories from a generally vertical orientation to a generally horizontal orientation. The horizontal component (or "lateral") of these extended-reach wellbores in the U.S. now averages a length of approximately two miles, often reaching three miles or even longer. These extended-reach laterals significantly multiply the wellbore exposure to a target hydrocarbon-bearing formation or "pay zone". As an example, consider a target pay zone having a (vertical) thickness of 100 feet. A one-mile horizontal leg exposes over 50 times as much pay zone to a horizontal wellbore as compared to the 100-foot exposure of a conventional vertical wellbore.

FIG. 1 provides a cross-sectional view of a wellbore 1 having been completed in a horizontal orientation. It can be seen that the wellbore 1 has been formed from the earth surface A, through numerous earth strata 2*a*, 2*b*, 2*e* and down to a hydrocarbon-producing formation 3 that represents a "pay zone" for the oil and gas operator.

In a typical horizontal well 1, one or more strings of casing 4 is run from the surface A, around the heel B, through the lateral C and to the end, or "toe", D of the well. The casing is then cemented 5 into place to provide additional zonal protection and isolation, in addition to wellbore stability. Once the casing 4 is run and cemented 5, completion operations commence to stimulate the pay zone 3 and prepare the well for production. Continuous (non-segmented or jointed, non-threaded and coupled) strings of steel coiled tubing (CT) 6 are often used to facilitate various phases of the completion, e.g. opening/closing sliding sleeves, drilling out frac plugs and making cleanout trips prior to flowing the well back and subsequently putting the well on production.

The use of coiled tubing allows various downhole operations to be performed more efficiently than with traditional jointed, threaded and coupled "stick" pipe, since CT does not have time-consuming pipe segment connections that have to be made-up going in the hole and broken out when coming out of the hole. Generally speaking, CT provides a faster means to trip in and out of the well. Coiled tubing, however, has its limitations. For example, surface pipe injection systems called injector heads can only push and pull so much on the CT when running and retrieving the CT. As more of the CT string is run out into the lateral, the drag forces coupled with the compressive buckling tendency of small diameter CT 6 inside large diameter casing 4 or boreholes, makes it difficult to get the CT to the toe D of the lateral. Coiled tubing tractors 7 are often used to help move the CT 6 when the coiled tubing string cannot be conducted all the way to the toe D of the well and back out due to friction, pipe weight, lateral C length, well geometry, etc. Despite these limitations, the efficiencies and in some cases, even the capabilities of CT cannot be matched by jointed or "stick' tubing. For example, in applications where electric power and/or real-time downhole data is required, an electric cable (or, wireline) can be installed inside and along the entire length of the coiled tubing string at the surface before the CT is run in the hole. In this cable-enabled configuration, the coiled tubing string is referred to as smart coil or e-coil.

As horizontal drilling technology advances and well economics continue to put cost-reduction and value-creation pressure on exploration and production (E&P) companies, the ability and the necessity to drill longer and longer laterals becomes prevalent among oil and gas producers. Further accentuating the trend of steadily increasing lateral lengths, World Oil's October 2020 issue featured NOV subsidiary Quality Tubing's manufacture of the longest and heaviest coiled tubing string ever built. Extending over 7.5 miles and weighing over 75 tons, excluding the drum, the 40,000 feet of 2⅜" OD coiled tubing was installed on a single reel and shipped to the Middle East. The potential economic advantages of drilling longer laterals plays a significant role in E&P company strategies. Drilling and completing a single well with a two-mile lateral, for example, can effectively replace the need for two single-mile lateral wells. The two-mile lateral well can effectively drain the same stimulated reservoir volumes (SRV's) as the two shorter lateral wells in this example. Drilling a single extended-reach well rather than two individual wells with shorter laterals can prove much more cost effective when the finding and development cost of recoverable reserves is evaluated versus shorter lateral approaches. In this simple illustration, the costs of drilling, installing and cementing casing in an additional vertical section, as well as wellhead and surface piping equipment costs for a second well are eliminated. Furthermore, there is less environmental impact since only one surface location is required in an extended-reach well approach rather than two surface locations (or, a larger single location) in a multiple-well, shorter-lateral scenario.

Despite the fiscal and environmental benefits of drilling and completing longer laterals, these extended reach wellbores create their own set of operational challenges. One of the more significant challenges created by longer laterals centers around getting the coiled tubing string (e-coil and conventional coil) to the toe D of the well and back out efficiently. Spears Research expressed concerns created by longer laterals in their "Well Servicing and Coiled Tubing Markets" report published March of 2021 by stating, " . . . with new horizontal laterals now regularly exceeding 10,000' in the U.S., coiled tubing runs into a mechanical limit." Because of the additional frictional forces created by longer and often larger diameter coiled tubing strings 6, reaching the toe D of the well becomes more difficult and costly. Vibration or agitation tools, lubricating fluids (a.k.a. friction reducers), and other techniques are often employed to help overcome these higher frictional forces. As the length of these laterals increases, so does the length and the weight of the coiled tubing laying in the bottom of the lateral, as well as the surface contact area between the CT and the casing/borehole wall, thereby increasing the frictional forces proportionately. Eventually, these frictional forces begin to exceed the amount of compressive forces that can be placed on the coil to "push" it into the lateral. The compressive forces generated by the injector head are insufficient to overcome the frictional forces and thereby move the coil all the way to the toe D when run in longer laterals. As greater compressive force is applied, mechanical buckling occurs in the CT string 6, much like the coils in a spring, whereupon continuing to advance the proximal portion of the CT string from surface can drive the distal portion into the downhole phenomena known as CT "lockup". In addition to the compressive force challenges, the tensile forces to retrieve the coiled tubing from these extended laterals can exceed coiled tubing tensile capacity and/or the pulling capabilities that the injector head and associated surface equipment can generate. In essence, the CT 6 can be tractored far enough into the lateral that it cannot be retrieved without tractor assistance back out of the lateral. Bi-directional capability of a CT tractor provides the means to move the coil distally into the well and proximally back toward the heel B of the well such that the CT 6 can be retrieved.

Coiled tubing tractors were developed to assist in overcoming the forces created by CT pipe weight, mechanical buckling and pipe friction between the outer surface of the coiled tubing and the inner surface of the production tubing, casing, or open hole. These frictional forces are encountered in the entire wellbore, especially in the heel B and the lateral C portions of the wellbore. In many cases, tractors provide assistance in overcoming frictional forces with extendable arms that protract to the ID of the casing or (openhole) borehole along with a means of gripping the enclosing pipe or borehole surface. Two general categories of tractors are electric and hydraulic. Electric tractors heretofore have been restricted to configurations whereby small electric motors power wheels that extend from within the CT body to engage the casing or borehole wall. These "wheel type" tractors typically have only a fraction of the pulling force provided by hydraulically powered "gripper type" tractors. Hence electric wheel type tractors have been relegated to one of two generally lighter duty applications: (1) Conveying electric cable used in downhole operations (such as well logging), commonly referred to as "wireline", whereby the small electric motors receive power by means of that same wireline, which itself comprises a significant portion of the payload; or (2) conveying a small CT payload in an application requiring a commensurately low maximum pulling force . . . typically below 5,000 lbf. Note that these later applications are typically supplied electric power via hydraulic generation from a "mud motor" run immediately above the wheel type CT tractor. In these configurations, the trade-offs to be considered are generally: (A) Payload (wheel types generally have a fraction of the pulling force of gripper types); and (B) Speed (wheel types are typically faster . . . perhaps by a factor of 3 times or more); and lastly (C) Pressurized fluid requirement (wheel types require several multiples more of a pressurized fluid requirement than gripper types, by virtue of the fluid demand to operate the mud motor). Notwithstanding, it will be demonstrated herein . . . chiefly by interposing the application of very powerful electro-mechanical actuators . . . how electric power can be used to both extend the grippers and propel a gripper type tractor.

Coiled tubing tractors are placed at or near the end of the coiled tubing tool string and apply tensile force to help pull the CT into the well, thereby keeping the CT straight to better withstand the injector head compressive forces. Some CT tractors are capable of reversing and can be used to help push the coil out of the hole to prevent tensile failure of the CT and/or over-stressing of the injector head and other surface equipment. The tractor assists in moving the CT uphole until the injector head pulling capacity is sufficient to move the CT without further tractor assistance. Pulling forces from the surface must be monitored to avoid potential injector head, coiled tubing, and/or wireline failure if their respective tensile limits are exceeded.

As mentioned previously, the two more common CT tractor propulsion configurations currently available are the intermittent "inchworm" or "caterpillar" gripper type models, versus the continuous propulsion wheel types. The inchworm action of gripper type CT tractors is reflected in the sequential gripping-pulling-releasing actions that propel the CT string. This intermittent method transmits greater forces to the coiled tubing string and is thereby able to move the payload further into extended reach laterals. However, when either type can move the payload, the intermittent system is almost always the slower means of transporting the CT string to the toe of the well due to its stop-start motion, which necessitates the tractor overcome the higher static frictional forces during each cycle to conduct movement in the CT string. The continuous wheel-type propulsion tractors keep the CT string moving through the continual gripping and rotating action of the wheels and thereby avoid subjecting the CT tractor to the higher resistance from the static frictional forces. The less resistant dynamic frictional forces allow the wheel-type tractors to move the coil more quickly than the intermittent inchworm devices, yet can often be subject to greater wear at the wheel-casing or wheel-borehole wall interface, especially in cases where scale or debris may be present on the wall surface. This wear can cause the wheel-type tractors to be less reliable in longer extended-reach lateral applications. A faster, more efficient continuous-motion tractor with the higher load capability and wear resistance of an intermittent tractor would leverage the respective advantages of both tractor methods currently available by conveying CT strings to the toe of longer, extended-reach laterals faster, more reliably and therefore, more cost effectively.

As mentioned previously, the use of vibratory devices, or "agitators", and other friction-reducing technology has assisted in CT tractoring operations by reducing the friction acting on the CT and by transporting the CT string in short incremental movements when used in conjunction with a shock tool. Although these agitating, friction-reducing devices are beneficial in tractoring, they may also increase CT fatigue, damage sensitive electronics, degrade casing connection integrity and compromise casing-cement bonds thereby potentially adversely impacting stage isolation. In some cases, the adverse impact of these devices on casing and cement bond integrity can be irreparable, permanently compromising the well over its productive life. The ability to tractor longer, heavier coiled tubing strings without the use of agitating/shock devices would eliminate these short and long-term potential drawbacks to friction-reducing devices.

As laterals lengths continue to increase, the ability to transport heavier CT loads more efficiently without the use of potentially harmful vibratory agitation devices or lubricating chemicals is tantamount to the long-term success of extended-reach horizontal well completion operations. Thus, what is needed is a means of transporting heavier e-coil strings in multi-mile extended-reach wellbore laterals without the need of hydraulic pressure or vibratory devices. The present disclosure describes a significantly more powerful and totally electrically-driven tractor, or "e-Tractor", that is capable of extending coiled tubing reach to accommodate longer wellbore laterals that arc becoming more prevalent. In addition to generating higher pulling and pushing capacities, the e-Tractor of this present disclosure moves the run-in string at tractoring speeds consistent with or greater than current tractor technology, while additionally providing critical real-time downhole tensile/compressive force, location and orientation data back to the surface. Further, the apparatus and method of the present disclosure will enable switching configurations as needed based on the application, from the intermittent tractoring motion and less powerful single e-Tractor mode to the continuous and more powerful multiple e-Tractor mode when operations require higher tractoring efficiencies and/or greater pulling capacities. Finally, the apparatus and method will preferably also be robust enough to withstand hundreds of bi-directional, gripping-tractoring-resetting cycles at downhole conditions consistent with coiled tubing tractoring operations, particularly those common in deeper and/or longer horizontal laterals.

SUMMARY OF THE INVENTION

The systems and methods described herein have numerous advantages in the insertion and withdrawal of coiled tubing in horizontal wellbore laterals, especially those wellbores whose length, undulations or other parameters necessitate the use of motion-generating or friction-reducing devices and techniques to get the coiled tubing string to the end or "toe" of the wellbore. Specifically, additional advantages occur when the wellbore can be accessed by an electric power source, as with an electric cable (or "wireline"), a tubular conveyed downhole generator or battery pack, or more preferably, coil tubing equipped with an electric cable ("e-coil").

In one aspect, there is provided an electric motor-actuated tractor (e-Tractor) apparatus for use in a well casing or a borehole. The e-Tractor apparatus preferably comprises: (a) a longitudinally extending inner body assembly; (b) a gripper assembly movable between (i) a retracted position and (ii) an outward gripping position for engaging an inner surface of a well casing or a borehole; and (c) a linear actuator subassembly, in the inner body assembly, comprising a longitudinally extending screw, at least one bi-directional electric motor which is directly or indirectly coupled to an end of the screw, and a nut which is positioned on the screw, the nut being locked against rotation. The rotation of the screw by the at least one bi-directional electric motor in a first rotational direction when using the e-Tractor apparatus in the well casing or the borehole causes the nut to move in a first longitudinal direction with respect to the inner body assembly. This causes the gripper assembly to move from its retracted position to its outward gripping position. Then, with the gripper assembly in its outward gripping position, the continued rotation of the screw by the at least one bi-directional electric motor in the first rotational direction pulls or pushes the inner body assembly in a second longitudinal direction, opposite the first longitudinal direction, with respect to the gripper assembly.

In another aspect, there is provided a downhole apparatus for use in a well casing or a borehole. The downhole apparatus preferably comprises a run-in string and one or more e-Tractor apparatuses. Each of the one or more e-Tractor apparatuses preferably comprises: (a) a longitudinally extending inner body assembly having an end which is connected to the run-in string or connected to another tool in a tool string which is connected to the run-in string; (b) a gripper assembly movable between a retracted position and an outward gripping position for engaging an inner surface of the well casing or the wellbore; (c) a linear actuator subassembly, in the inner body assembly, comprising a longitudinally extending screw, at least one bi-directional electric motor which is directly or indirectly coupled to an end of the screw, and a nut which is positioned on the screw, the nut being locked against rotation, and (d) a motor control which is electronically connected to the at least one bi-directional motor. The motor control of each of the e-Tractor apparatuses is preferably operable to control the at least one bi-directional electric motor to (1) rotate the screw of the e-Tractor apparatus in a first rotational direction, in a first stage of operation, which causes the nut to move in a first longitudinal direction with respect to the inner body assembly which moves the gripper assembly from its retracted position to its outward gripping position at a first setting location in the well casing or borehole, and then (2) continue to rotate the screw in the first rotational direction, in a tractoring stage of operation, with the gripper assembly in its outward gripping position, which pulls or pushes the inner body assembly and the run-in string in a second longitudinal direction, opposite the first longitudinal direction, with respect to the gripper assembly, and then (3) rotate the screw in a second rotational direction opposite the first rotational direction, in a third stage of operation, which causes the nut to move in the second longitudinal direction with respect to the inner body assembly to a point for releasing the gripper assembly, and then (4) continue to rotate the screw in the second rotational direction, in a fourth stage of operation, which causes the nut to continue to move in the second longitudinal direction with respect to the inner body assembly to release the gripper assembly and then move the gripper assembly in the second longitudinal direction to a next setting location in the well casing or the borehole.

In another aspect, there is provided a method of moving a run-in string longitudinally in a well casing or a borehole. The method preferably comprises the step of providing a plurality of electric motor-actuated tractor (e-Tractor) apparatuses, each of the plurality of the e-Tractor apparatuses being either connected to the run-in string or included in a tool string which is connected to the run-in string, and each of the plurality of the e-Tractor apparatuses preferably comprising a gripper assembly and at least one bi-directional electric motor which is operated to turn a screw in the e-Tractor apparatus to cause the e-Tractor apparatus to repeatedly (1) perform a first operation in which the gripper assembly is moved from a retracted position to an outward gripping position in contact with an inner surface of the well casing or the borehole at one location in the well casing or the borehole, and then (2) perform a tractoring operation which pulls or pushes the run-in string in a first longitudinal direction in the well casing or the borehole for a tractor interval distance, and then (3) perform a third operation which includes retracting the gripper assembly from its outward gripping position to its retracted position, and then (4) perform a fourth operation in which the gripper assembly is moved in the first longitudinal direction to a next setting location in the well casing or the borehole.

This method preferably further comprises the step of operating the plurality of the e-Tractor apparatuses in a continuous tractoring mode in which whenever any one of the e-Tractor apparatuses is performing any of the first, the third, or the fourth operations, at least one other of the plurality of the e-Tractor apparatus is performing the second operation.

In another aspect, there is provided an apparatus comprised of an electric motor-actuated tractor ("e-Tractor") system and methods for its application. The e-Tractor apparatus provides a means of tractoring coiled tubing into and out of a horizontal or deviated wellbore lateral utilizing electric motor actuation to pull and push the coiled tubing laterally without the addition of surface pipe injection equipment, applied hydraulic pressure or friction-reducing techniques or devices. e.g. vibration and agitation tools.

In another aspect, there is provided an apparatus for use in a wellbore. The apparatus preferably comprises a tractor assembly having: (a) an inner body protruding from each end of the outer sleeve and connectable to the tubular or wireline run-in string and/or other components in the bottomhole assembly (or BHA) including other tractoring apparatuses; (b) an outer sleeve having a longitudinally extending exterior; (c) an inner sleeve concentric to the outer sleeve; (d) a pair of gripper subassemblies having a plurality of gripping devices on the exterior of the body at the upper and lower ends of the outer sleeve (e) a linear actuator subassembly in the inner sleeve which includes and is driven by bi-directional electric motors located at the upper and lower end of the inner sleeve; (e) a mechanical linkage subassembly which is linked to the linear actuator subassembly and is moved longitudinally by the linear actuator subassembly to engage the gripper subassemblies and transfer longitudinal intermittent motion of the inner body relative to the outer sleeve and gripper subassemblies to pull (or "tractor) the run-in string into or out of the wellbore.

In yet another aspect, the apparatus can also comprise the flow-through capabilities to run hydraulic or "mud" motors beneath the tractors. Such mud motors may also include an attached drill bit or mill for the removal of sand bridges, drillable bridge plugs and other wellbore debris and obstacles as is common with mud motor applications. By applying the longitudinal pushing force created by the tractor to the mud motor-bit assembly and thereby on the debris/object to be removed, the effectiveness of the drilling operations is increased. The additional applied longitudinal force by the tractor to the mud motor and bit assembly is further optimized by the application of this compressive tractoring "weight on bit" force at or very near the top of the mud motor and bit assembly, creating a "drill press" effect of sorts.

In another aspect, the apparatus can also comprise the flow-through capabilities to run hydraulic generators in the e-Tractor tool string, preferably above the e-Tractor(s), to provide at least temporary power to the tractors in lieu of or in conjunction with cable-enabled power from the surface generating equipment. Such hydraulically-enabled downhole power generation could be a source of independent power in the event cable-enabled power from the surface is unavailable or undesirable, as would be the case for example, whereby non-electric cable enabled, threaded and coupled (or "stick") pipe is used rather than continuous coiled tubing for a particular application. Additionally, hydraulically-enabled downhole electric power from a generator device could be used as a backup power source for the e-Tractors in the event cable integrity is lost. In such cases, an alternative long-term power source would be available to continue powering the tractor to complete the tractoring operations or rather to provide short-term power to release the e-Tractor such that it could be retrieved from the well such that cable repairs could be made.

In still another aspect, multiple tractor assemblies can be run in succession, for example in a preferred triple-tractor configuration to a) provide continuous tractoring motion, thereby i) translating the tubular run-in string into or out of the wellbore more efficiently by eliminating start-stop cycles and, ii) avoiding the higher resisting forces of static friction, thus reducing stresses in the tractoring apparatuses, CT, and the well casing; and b) generating multiples greater total tractoring forces than available in current technology, thereby i) enabling the tractoring of heavier tubular run-in string loads and ii) eliminating the need for any friction-reducing chemicals, or vibrating or agitating techniques or devices.

In another aspect, there is provided an apparatus for use in a wellbore, wherein the apparatus preferably comprises a tractor assembly having: (a) a body running inside an outer sleeve and connected to an inner sleeve; (b) an outer sleeve having a longitudinally extending exterior; (c) an inner sleeve containing and attached to a linear actuator subassembly through a mechanical linkage subassembly incorporating the inner sleeve comprising one or more electric motors, a screw which is rotated by one or more electric motors, and a nut positioned on the screw which is locked against rotation to the inner sleeve and which moves linearly along the screw as the screw is rotated by one or more electric motors and creates relative linear motion between the screw-inner sleeve assemblies and the outer sleeve-gripper assemblies; (d) a gripper subassembly having a plurality of gripping devices on the exterior of the body at the upper and lower portions of the tractor apparatus; and (e) a mechanical linkage subassembly which is connected to the nut and is moved longitudinally by the nut to engage the upper or lower gripper subassembly depending on the direction of the motor rotation in order to move the grippers outwardly from the body to an anchoring position against the wellbore casing.

In another aspect, there is provided an apparatus for use in a wellbore, wherein the apparatus preferably comprises a tractor assembly having reversible electric motors at each end of a screw connected to a nut which is rotationally locked by a mechanical linkage to an inner sleeve that (a) when the motors rotate the screw in a first direction, the screw shaft translates linear motion to the nut-mechanical linkage-inner sleeve assemblies creating a distal (downhole) motion of the tractor body and tubular run-in string to which the body is connected, effectively pulling the tubular or wireline run-in string into the wellbore; and (b) when the motors rotate the screw in a second direction, the screw shaft translates linear motion to the nut-mechanical linkage-inner sleeve assemblies creating proximal (uphole) motion of the tractor body and tubular run-in string to which the body is connected, effectively pushing the run-in string out of the wellbore.

In another aspect, there is provided an apparatus for use in a wellbore, wherein the apparatus preferably comprises a multiple tractor assembly having the group of individual tractor assemblies run in succession to provide a constant pulling force and thereby continuous motion of the run-in string. In a preferred multiple tractor assembly arrangement, for example, three tractors may be run in succession whereby each tractor is in a different position along its respective setting stroke. For example, as a first tractor assembly is approaching the beginning of its pulling stroke, a second tractor assembly approaches the middle of its pulling stroke, and a third tractor approaches the end of its pulling stroke. A first tractor assembly and a second tractor assembly are each pulling up to 15,000 lb for a total pulling capability up to 30,000 lb. A third tractor assembly is not contributing to the pulling force being applied to the run-in string, but rather is resetting the linear actuator to the beginning of its pulling stroke preferably at a higher velocity than the pulling stroke velocity, while a first tractor assembly moves toward the middle of its pulling stroke and a second tractor assembly moves toward the end of its pulling stroke. Once a first tractor assembly reaches the middle of its pulling stroke and a second tractor assembly reaches the end of its pulling stroke, a third tractor assembly has begun resetting to the beginning of its pulling stroke. So, the sequence in the example of a triple-tractor continuous-motion mode operation is that a first and a second tractor assembly are generating the longitudinal pulling forces required to move the run-in string while a third tractor assembly is resetting. The gripping-pulling-resetting cycle is repeated interminably during the continuous-motion tractoring mode operations.

In another aspect, the multiple tractor configuration in the continuous tractoring motion mode could be used not only to augment the pulling/pushing forces supplied by the pipe injection equipment at the surface, but rather the e-Tractors in this continuous motion scenario by providing sufficient independent pulling/pushing force to meet operational requirements could thereby eliminate the need for the surface injection equipment entirely. By eliminating the need for surface pipe injecting equipment, the stresses to the coiled tubing from these pipe injection devices (SPE 194254. "Study on Mechanism of Coiled Tubing Surface Damage in Injector Heads", Z. Zhou, et. al.) and their respective detrimental impact on coiled tubing fatigue is eliminated, increasing the run life of the coiled tubing and reducing overall operating expense. Injector head-independent pulling/pushing could also be performed with single tractors and/or intermittent mode e-Tractors, but less efficiently than with the aforementioned multiple tractor, continuous motion configuration.

In another aspect, there is provided an apparatus for use in a wellbore, wherein the apparatus comprises a multiple tractor assembly having a group of individual tractor assemblies run in succession in an intermittent tractoring mode to generate the maximum pulling force possible in a multiple-tractor assembly configuration. Whereby in an intermittent tractoring mode and multiple-tractor configuration, the tractors are run in succession and all of the tractors are generating their respective longitudinal pulling forces simultaneously to move the run-in string into or out of the wellbore. Whereby all the tractors are pulling simultaneously in the intermittent-motion tractoring mode, all of the tractors are in the same relative positioning along their respective pulling strokes, in as much as none of the tractors are resetting while the others are pulling as in the multiple-tractor continuous-motion tractoring mode. For example, in a triple-tractor configuration actuated in the intermittent tractoring mode, each of a first tractor assembly, a second tractor assembly and a third tractor assembly would be generating their respective longitudinal pulling forces to move the run-in string for the entire length of their respective tractoring strokes until such point a first tractoring assembly and a second tractoring assembly and a third tractoring assembly reach the end of their respective tractoring strokes and all begin resetting simultaneously. Whereby all three of the tractors in a triple-tractor intermittent-tractoring mode example, each of a first tractor assembly and a second tractor assembly and a third tractor assembly would be resetting simultaneously such that no longitudinal tractoring forces would be generated during the resetting period. Tractoring would commence after such point a first tractoring assembly and a second tractoring assembly and a third tractoring assembly returned to the beginning of their respective tractoring strokes and their respective longitudinal tractoring forces could be again generated simultaneously.

In another aspect, there is provided an apparatus for use in a wellbore, wherein the apparatus preferably comprises a multiple tractor assembly having the group of individual tractor assemblies run in succession to provide either a constant pulling force and thereby continuous motion of the tubular run-in string or an intermittent pulling force to generate the maximum pulling force possible in a multiple-tractor assembly configuration whereby switching from continuous-motion tractoring mode to the more powerful intermittent-tractoring mode as necessitated by the well conditions and related operating parameters could be performed using signals from the surface through the electronic and/or fiber-optic cable to the electronic controls for the respective tractor motors.

In another aspect, there is provided an apparatus for use in a wellbore, wherein the apparatus preferably comprises a single intermittent-tractoring mode assembly or a multiple-tractor assembly. The single tractor assembly or preferably a multiple-tractor assembly, having a higher force-generating group of individual tractor assemblies run in succession to provide either a constant pulling force and thereby continuous motion of the tubular run-in string or an intermittent pulling force to generate the maximum pulling force possible in a multiple-tractor assembly configuration, is whereby augmented with a downhole sensor package that could contain a tensiometer or other force measuring device to ensure the tensile strength of the coiled tubing and/or other force-dependent parameters are not exceeded.

In another aspect, the apparatus can further comprise: (a) supplying power to the electric motor and sending signals to the electronic unit via an electric cable and/or fiber optic cable or other electric wireline which extends through or is incorporated in the tubing string: (b) a position/orientation sensor package including a tensiometer or other load measuring device; and (c) receiving signals from the sensor package via wireline and/or fiber optic cable such that directional drilling survey data such as azimuth, inclination, etc. based model can be used to optimize the coiled tubing size, desired tractoring force limits and thereby impact frac parameters associated with the annular volume between the coiled tubing run-in string OD and casing or wellbore ID. For example, it may be preferable to run a smaller diameter coiled tubing string that will require more tractoring because of the smaller OD coiled tubing's greater buckling tendency when subjected to compressive forces from the injector head. In such cases, it may be necessary to begin tractoring earlier, i.e. further uphole, in the movement toward the toe of the lateral than it would be with a larger coiled tubing run-in string that could withstand greater compressive loads and thereby be pushed further into the lateral with the injector head, hence requiring tractoring later or further into the lateral. Conversely, the smaller coiled tubing run-in string diameter creates a larger annular space between the coil OD and the casing ID, reducing pump friction and pump pressure during hydraulic fracturing operations allowing further optimization of an annular frac. Using the sensor data available to monitor run-in string stress allows optimization of the run-in string as well as associated frac parameters.

In another aspect, the apparatus can further comprise the electric motor subassembly of the apparatus also including one or more batteries for supplying short-term backup power to the electric motor and/or sending signals to the electronic unit to disengage the gripper mechanism from the wellbore wall in the event a loss of cable power and the subsequent need occurs to release and retrieve the apparatus for evaluation or repair.

In another aspect, the apparatus can further comprise the electric motor subassembly of the apparatus also including: (a) one or more batteries for primary power to the electric motor and/or sending signals to the electronic unit to operate the tractor: (b) an electric cable through which one or more batteries are charged.

In another aspect, there is provided a method of performing a downhole operation in a wellbore. The method preferably comprises the steps of: (a) running a tubing string into the wellbore, the tubing string having an electric motor-actuated apparatus positioned on the tubing string or in a tool string connected to the tubing string, the electric motor-actuated apparatus comprising (i) a body having a longitudinally extending exterior, (ii) a linear actuator subassembly in the body which includes and is driven by one or more electric motors, (iii) one or more of a gripper subassembly, having a plurality of gripping constituents on the exterior of the body, and (iv) a mechanical linkage subassembly which is linked to the linear actuator subassembly and (b) setting the grippers by activating the electric motor to move the mechanical linkage to (i) engage the gripper subassembly to move the grippers outwardly to an anchoring position in contact with an interior wall of a casing in the wellbore or borehole wall, and/or (ii) generate a longitudinal force to translate an inner body linearly relative to an outer body and thereby move a run-in string proximally or distally within a wellbore in a continuous-motion or an intermittent-motion tractoring mode.

Recent developments in relatively small electric motor and gearing technologies have given rise to torsional force capabilities sufficient to actuate linear ball and roller screw assemblies at downhole conditions consistent with upstream oil and gas operations, that is, to generate well into the thousands of pounds of longitudinal force. One or more e-Tractors can be activated and repeatedly deployed without hydraulic pressure or run-in string manipulation making the e-Tractor system compatible with various e-coil systems and tools and permits, for example, multiple e-Tractors to be run in succession for longer lateral and/or heavier coiled tubing string applications that require greater longitudinal force-generating capability than is available using current tractoring technology.

In addition to avoiding hydraulic manipulation, the e-Tractor apparatus can be engaged and released without any additional coiled tubing or other run-in string reciprocation being required. This extends the useful life of the run-in string, especially in the cases where the run-in string is coiled tubing that suffers additional fatigue with each movement of the coiled tubing over a stress-inducing injector head and gooseneck/guide-arch. Furthermore, the e-Tractor apparatus' multiple-tractor, dual switchable tractoring mode capabilities allow the e-Tractor system to accommodate various tractoring applications and in either distal or proximal run-in string movement.

The electro-mechanical, bi-directional, longitudinal force-generating process utilizing the roller screw linear actuation system preferably enables the unique operational flexibility to utilize the e-Tractor apparatus located at or near the distal end of the run-in string for both distal, or pulling force-generation and proximal, or pushing force-generation to tractor the run-in string to the toe of the lateral and/or to push the run-in string back out of the well, respectively, to the point at which the injector head and gooseneck surface equipment can generate the forces required to retrieve the run-in string without further tractoring assistance. This bi-directional tractoring flexibility is preferably enabled through reversing the rotation of the electric motors through the electronic controls thereby reversing the roller screw to translate the e-Tractor mandrel (or, "body") relative to the gripper and outer housing, thereby moving the run-in string accordingly.

The ability to electrically power downhole tractors with e-coil (with or without fiber-optic capability) while omitting the need for hydraulics or mechanical manipulation enables multiple e-Tractors to be run in sequence, greatly increasing the total available tractoring force far beyond current tractoring technology. For example, WWT International states that the "WWT CT Tractor has greater pulling power than any tractor on the market", and that their Model 470 delivers 14,500 pounds of carrying capacity with varying capacities for their other models (https://www.wwtco.com/products/wwt-coiled-tubing-tractors). WWT's self-titled "Pulling Powerhouse" at 4.7" OD is incompatible with 5½" OD and smaller casing, yet the stop-start pulling force the WWT tractor is notable. Over 9/16" smaller in diameter at 4⅛" OD, Coiled Tubing Specialties' (CTS's) e-Tractor presented in this disclosure is suitable for the 5½" and larger casings commonly used in horizontal well design. When run in the triple-tractor configuration in continuous motion tractoring mode, the CTS e-Tractor is capable of more than doubling the 14,500 lb. pulling capacity of WWT's "470" with 30,000 lb. continuous pulling force, or more than tripling the WWT "470" ratings with 45,000 lb. e-Tractor intermittent-mode pulling capacity. Even in the CTS e-Tractor's less powerful continuous-motion tractoring mode, the triple tractor configuration of the e-Tractor generates nearly two and a half times the pulling force per inch of tool diameter as compared to the WWT 470 tractor. The c-coil enabled electro-mechanical e-Tractor system also allows additional redundant e-Tractors to be run providing additional system reliability. With CTS's e-Tractor's adaptability to existing real-time data acquisition and fiber optic-enabled technology, (e.g. Halliburton's SPECTRUM® FUSION Real-Time Coiled Tubing System) position, orientation, temperature and other sensors can be run to provide additional information back to the surface. Given the vast potential pulling capacity of the e-Tractor system, it may be desirable to include a tensiometer in the sensor package to ensure the tensile strength of the coiled tubing is not exceeded.

An "e-coil", or "smart coil" run-in string, can be any reel-deployed, or "coiled", tubing system that includes wireline capabilities, and may or may not include fiber optic capability.

The advent of e-coil technology paired with fiber optic cable and positional, tool face, tension, pressure and temperature sensor packages for real-time data acquisition, like the Halliburton SPECTRUM FUSION system, also broadens the applicability of the inventive CTS e-Tractor apparatus. The ability to get real-time data at bottomhole conditions makes it possible to determine stress in the coiled tubing, weight on bit in milling and cleanout applications, positional, locational and other information adding efficiencies and effectiveness to various downhole e-Tractor enabled operations.

DETAILED DESCRIPTION OF THE PREFERRED EMBODIMENTS

Figure 1:
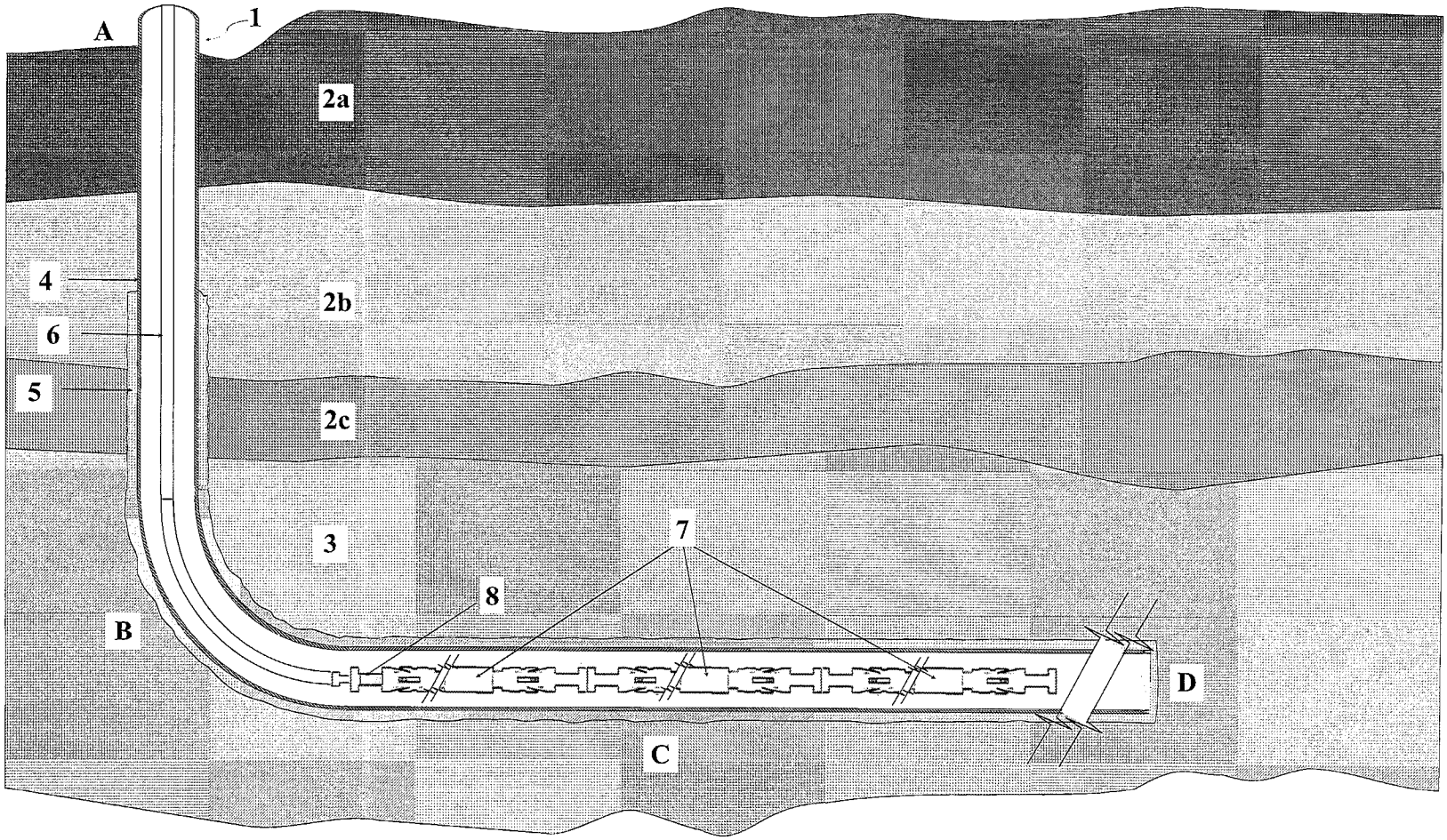
FIG. 1 provides a cross-sectional view of a wellbore having been completed in a horizontal orientation with a triple e-Tractor assembly configuration depicted on the proximal end of the coiled tubing string.

FIG. 1 is a cross-sectional view of an illustrative horizontal wellbore 1 with multiple inventive, e-coil conveyed, electric motor-actuated e-Tractor assemblies 7 deployed in triple-tractor configuration. Multiple e-Tractors 7 are shown in FIG. 1 to represent both the intermittent-motion tractoring mode and the continuous-motion tractoring mode. The intermittent mode is used when the tractoring force available is more critical than the pace of the tractoring motion. In the intermittent mode, all the e-Tractors 7 in the multiple-tractor tool string can be used simultaneously to create the maximum pull or push, depending on motor rotation direction and the desired direction of CT movement. The ability to run and selectively actuate multiple c-Tractor assemblies 7 to switch from continuous to intermittent mode as needed helps optimize each tractoring operation. Likewise, the option to vary the pulling (pushing) force based on CT and/or well configuration as a function of the power applied from the surface and the ability of the electronics controls to monitor rotation and torque in each e-Tractor assembly helps further improve each phase of CT tractoring operations.

In the depicted example, when running in the continuous mode, three e-Tractors 7 are run in series such that while two of the tractors 7 are gripping and pulling, the third e-Tractor is resetting along the length of its roller screw such that the third e-Tractor 7 will engage as another e-Tractor travels to the end of its effective roller screw length, at which point that e-Tractor begins resetting. With this synchronized gripping-pulling-resetting sequence, two of the three e-Tractors 7 are always pulling such that the e-coil 6 is maintained in continuous motion. The ability to provide continuous movement of the e-coil 6 makes the tractoring operation more efficient by eliminating non-productive pauses between tractor-enabled, run-in string movement cycles. Further, and perhaps more importantly, the overall stresses on e-coil 6 are reduced and the incrementally higher force requirements (to overcome static friction, as opposed to kinetic) imposed on the e-Tractors 7 are avoided by maintaining constant (versus intermittent) motion.

The multiple e-Tractor 7 series configuration can also be operated in intermittent tractoring-motion mode. That is, in FIG. 1, all three c-Tractors would be maintained at the same approximate points in their respective tractoring strokes. Say, for example, subsequent to drilling out a frac plug at a specific depth the wellbore was being circulated clean while the CT was stationary. To proceed to the next frac plug location further downhole, the static friction force on the CT is 35,000 #, and after initiating CT movement the kinetic friction force reduces to 25,000 #. In this example, all three e-Tractors 7 (pulling up to 15,000 # each, or a maximum of 45,000 # combined) could be initially placed in intermittent mode to initiate CT movement, then the series switched to continuous mode (with up to 30,000 # pulling force) to maintain downhole advancement of the CT 6.

Figure 2:
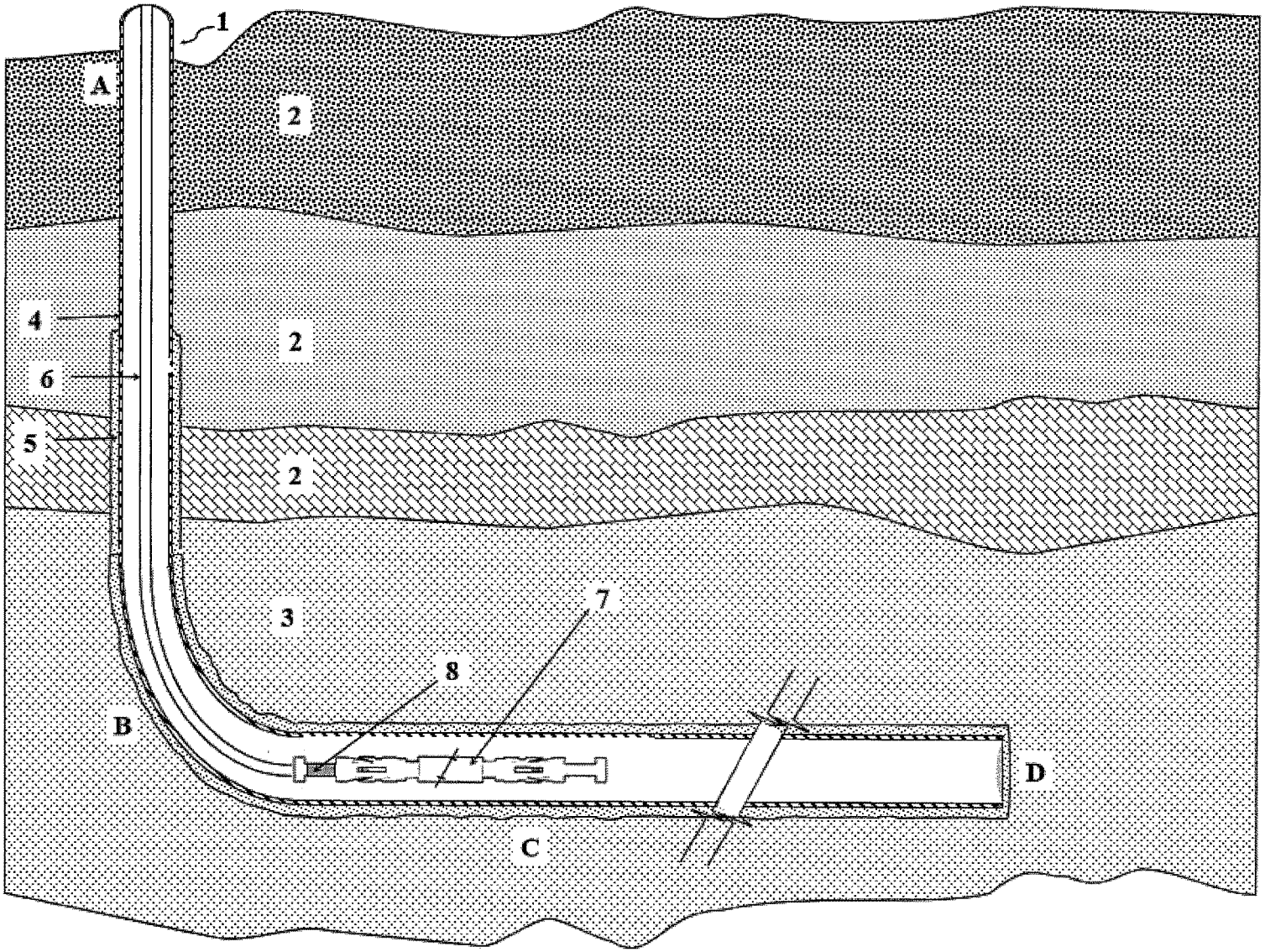
FIG. 2 provides a cross-sectional view of a wellbore having been completed in a horizontal orientation with a single e-Tractor assembly configuration depicted on the proximal end of the coiled tubing string.

FIG. 2 is a cross-sectional view, similar to FIG. 1, of an illustrative horizontal wellbore 1 with an inventive, e-coil conveyed, electric motor-actuated, e-Tractor assembly 7 deployed in a single-tractor configuration depicted in the wellbore lateral C. The single c-Tractor 7 is shown in FIG. 2 to represent the intermittent-motion tractoring mode, as the continuous-motion tractoring mode requires more than a single e-Tractor configuration which enable one e-Tractor to be resetting while another e-Tractor assembly is applying longitudinal force to the run-in string. Running the e-Tractor, in the intermittent-motion tractoring mode, however, does allow for the full force-generating capability of 15,000 lbs. for each e-Tractor to be leveraged in both single and multiple tractor configurations. Also, as depicted in FIG. 2, the single e-Tractor configuration creates a less complex, shorter bottomhole assembly (BHA) for applications not requiring the additional pulling force or pace of motion provided by a multiple e-Tractor configuration, thus providing greater efficiencies in less critical CT tractoring applications.

In shorter laterals and those applications requiring less tractoring speed than available in a continuous tractoring mode configuration, a single e-Tractor assembly provides nearly 50% greater tractoring capacity than other 5½" OD casing compatible tractors, rendering even the single e-Tractor configuration better suited to address more demanding tractoring load requirements as lateral lengths continue to grow.

Utilizing the power and data transmitting capabilities of e-coil, often including fiber optic capabilities embedded within the wireline cable, the present disclosure also describes the method and apparatus of an electric coiled tubing tractor, or "e-Tractor". The fiber optic-enabled cable, can provide both electric and fiber optic capability in a single wireline cable. Any number of sensors of any type can be used in or in association with the inventive e-Tractor assembly 1000. For purposes of illustration, a sensor 8 is shown in FIG. 1 for real-time sensing and/or measurement of a pressure, a temperature, a load, a stress, a tension, a position of the e-Tractor apparatus or of a component thereof, an orientation of the e-Tractor apparatus or of a component thereof, or a combination thereof.

Figure 3:
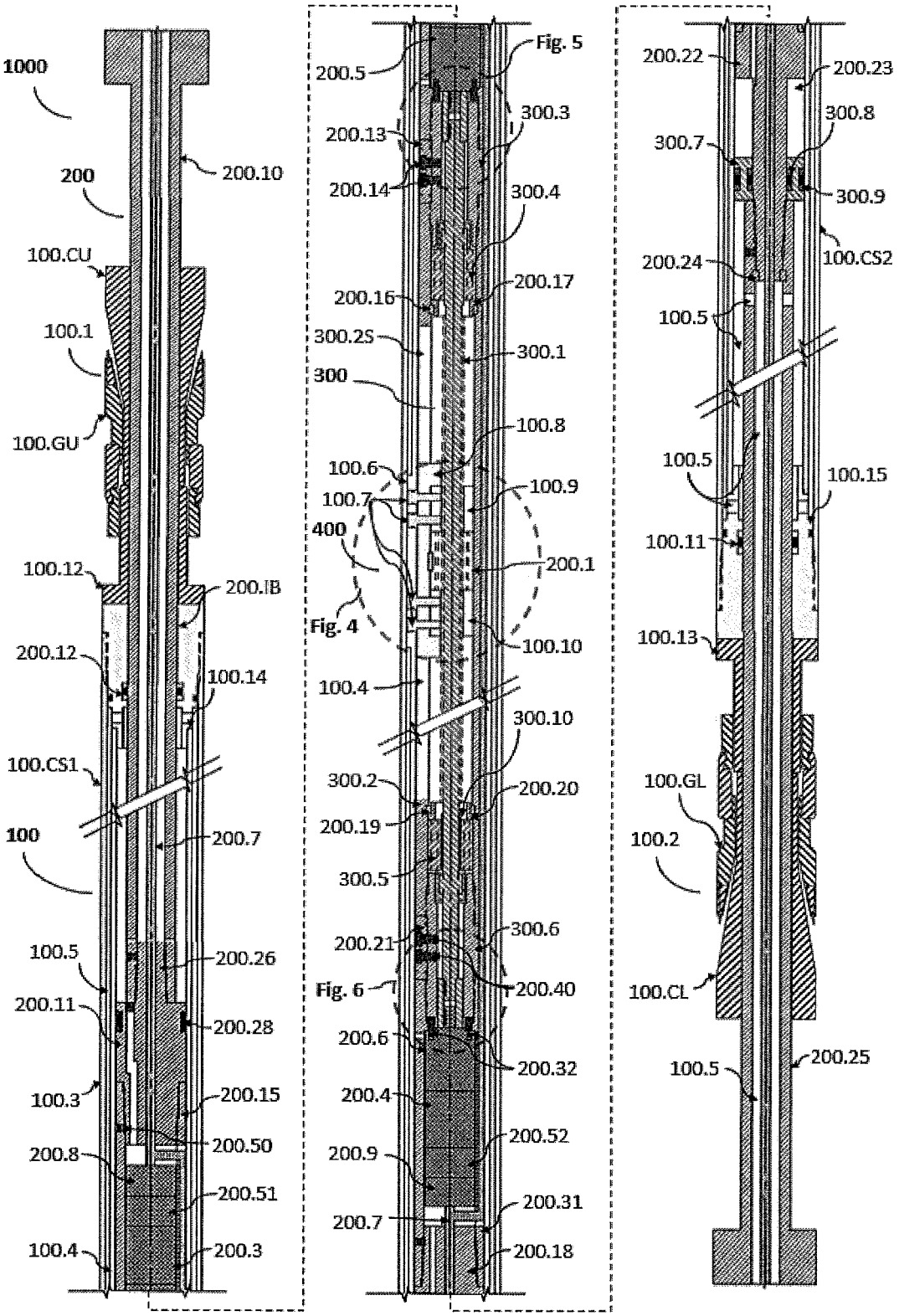
FIG. 3 is a cross-sectional view of the Coiled Tubing Specialties' e-Tractor as shown in three segments representing a single e-Tractor assembly.

FIG. 3 is a half-section view of the e-Tractor assembly 1000, an e-coil conveyed and operated downhole tractor used to pull coiled tubing into and push the coiled tubing out of the casing in a horizontal wellbore. The e-Tractor assembly 1000 comprises two main subassemblies, i.e. the tractor subassembly 100 and the power subassembly 200. The tractor subassembly 100 generally comprises the outer components of the e-Tractor assembly 1000 and incudes upper 100.1 and lower 100.2 gripper subassemblies that grip the casing 4 ID, thereby providing an anchor against which the coiled tubing 6 and power subassembly 200 can be pulled. The power subassembly 200 includes the inner assemblies for the upper 200.3 and lower 200.4 motors, upper 200.5 and lower 200.6 gearheads, upper 200.8 and lower 200.9 motor control electronics and roller screw shaft 300.1. The power subassembly 200 receives electric power from the e-coil unit power pack on the surface (not shown) through the electric cable 200.7 contained within the e-coil string 6 and converts it to longitudinal motion for pulling the coiled tubing 6 and e-Tractor assembly 1001) into the well casing 4.

As used herein and in the claims, the term "screw" refers to and includes a roller screw shaft or any other type of elongate screw or bolt which can be used for translating rotational motion into linear motion in the inventive e-Tractor assembly 1000.

Figure 4:
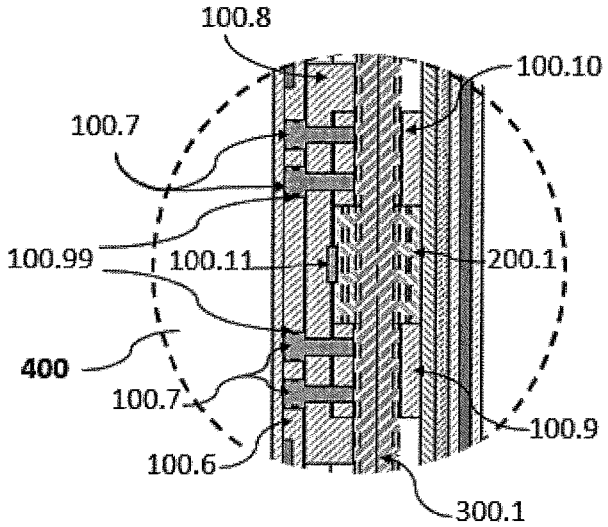
FIG. 4 is an inset of the mechanical linkage sub assembly and some of its components.

FIG. 4 is an inset drawing of the mechanical linkage subassembly 400 and some of its various components, including the lug 100.8, roller screw nut 200.1, upper 100.9 and lower 100.10 lug retainers, four pins 100.7 and the partial external upset 100.6 on the inner sleeve 100.4. Other mechanical linkage subassembly 400 components are indicated on FIG. 3 such that the components may be seen in the context of the entire c-Tractor assembly 1000.

As used herein and in the claims, the term "nut" refers to and includes a roller screw nut or any other type of nut or other internally threaded element which is compatible with the screw for translating rotational motion into linear motion in the inventive e-Tractor assembly 1000.

Figure 5:
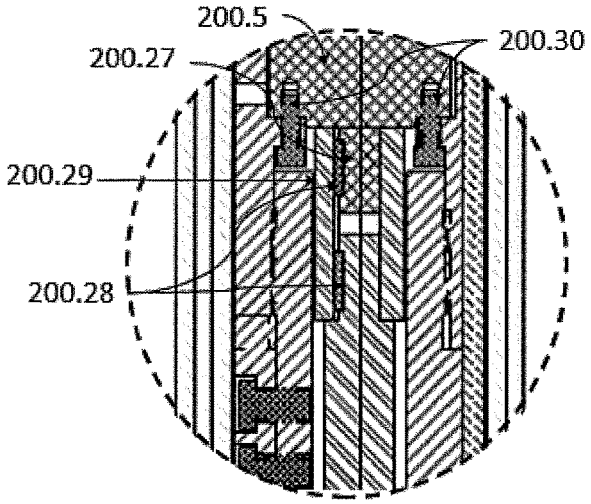
FIG. 5 is an inset of the upper gearhead and some of its components.

FIG. 5 is an inset of the upper gearhead output shaft 200.27 and related components. This includes the upper gearhead 200.5, cap screws 200.30, torque keys 200.28, and upper key coupling 200.29. Given the scale of FIG. 3 and the relative size of these components, the inset is provided for additional clarity.

Figure 6:
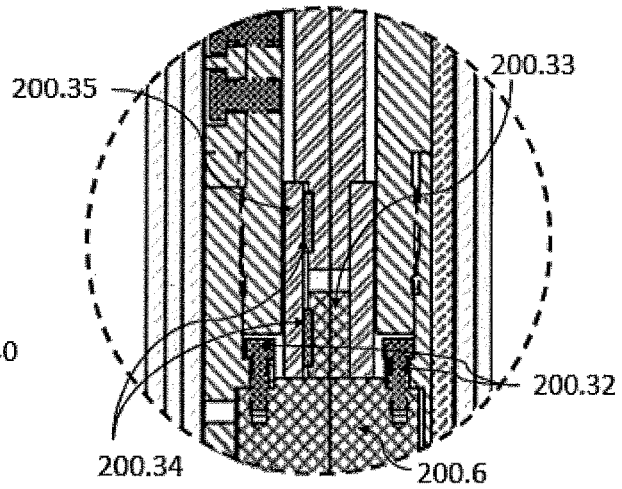
FIG. 6 is an inset of the lower gearhead and some of its components.

FIG. 6 is an inset of the lower gearhead output shaft 200.33 and related components. This includes the lower gearhead 200.6, cap screws 200.32, torque keys 200.34, and lower key coupling 200.35. Given the scale of FIG. 3 and the relative size of these components, the inset is provided for additional clarity.

The tractor subassembly 100 comprises the upper 100.1 and lower 100.2 gripper subassemblies that are connected by the outer sleeve or other outer housing 100.3. The outer sleeve (housing) 100.3 transfers the load from the inner sleeve 100.4 to the upper and lower gripper subassemblies. 100.1 and 100.2, respectively.

The upper gripper assembly 100.1 comprises an upper gripper sub 100.12 which is threadedly connected or otherwise made up to the upper end of outer housing 100.3. Similarly, the lower gripper assembly 100.2 comprises a lower gripper sub 100.13 which is threadedly connected or otherwise made up to the lower end of the outer housing 100.3.

The upper gripping sub 100.12 includes an end or shoulder 100.14 which is positioned within the upper end of the outer housing 100.3 for engagement by the upper end of the inner sleeve 100.4 to provide a carrying structure for the outer housing 100.3 so that when the upper end of the inner sleeve 100.4 contacts the carrying structure 100.CS1 and then continues to move upward, the outer housing 100.3 is also carried upward, with respect to the inner body assembly 200.IB of the e-Tractor assembly (identified below), which in turn pulls the cone piece 100.CL of the lower gripper assembly 100.2 upward beneath the slips or other gripper elements 100.GL of the lower gripper assembly 100.2 to thereby force the gripping elements 100.GL outward into engagement with the inner surface of the well casing or the borehole.

Similarly, the lower gripping sub 100.13 includes an end or shoulder 100.15 which is positioned within the lower end of the outer housing 100.3 for engagement by the lower end of the inner sleeve 100.4 to provide a second carrying structure for the outer housing 100.3 so that when the lower end of the inner sleeve 100.4 contacts the second carrying structure 100.CS2 and then continues to move downward, the outer housing 100.3 is also carried downward, with respect to the inner body assembly 200.IB which in turn pulls the cone piece 100.CU of the upper gripper assembly 100.1 downward beneath the slips or other gripper elements 100.GU of the upper gripper assembly 100.1 to thereby force the gripping elements 100.GU of the upper gripper assembly 100.1 outward into engagement with the inner surface of the well casing or the borehole.

The annulus between the outer sleeve 100.3 ID and inner sleeve 100.4 OD form part of the fluid flow path 100.5 through the e-Tractor. The inner sleeve 100.4 is made up on the OD of the power subassembly 200 and transfers longitudinal load from the roller screw nut 200.1. The inner sleeve 100.4 has a partial external upset 100.6 in the center 100.5 with the remainder of the external upset machined down to the inner sleeve 100.4 OD, providing a fluid flow path 100.5 around the external upset. Pins 100.7 located in radial holes through the partial external upset 100.6 extend through aligned radial holes in the lug 100.8 and upper 100.9 and lower 100.10 lug retainer. The roller screw nut 200.1 is made up on roller screw shaft 300.1 in the power subassembly 200. Rotary motion of the roller screw shaft 300.1 is translated into longitudinal motion of the roller screw nut 200.1 as power is directed to the upper 200.3 and lower 200.4 opposing bi-directional electric motors in each e-Tractor assembly 1000, through the respective upper 200.5 and lower 200.6 gearheads and into the roller screw shaft 300.1. Power is provided to the upper 200.3 and lower 200.4 electric motors through the cable 200.7 from the surface. The upper 100.9 and lower 100.10 lug retainers are sleeves shouldered against the upper and lower ends of the roller screw nut 200.1 and are used to transfer longitudinal force from the roller screw nut 200.1 to the lug 100.8 through pins 100.7 that extend through radial holes in the upper 100.9 and lower 100.10 lug retainers and shoulders at each end of the lug 100.8. A key 100.11 is inserted in an external slot on the roller screw nut 200.1 and internal slot in the lug 100.8 to rotationally lock the roller screw nut 200.1 and the lug 100.8 together. The lug 100.8 is assembled in the slot in the screw housing 300.2 in the inner sleeve 100.4 and over the roller screw nut 200.1 and upper 100.9 and lower lug 100.10 retainers. The lug 100.8 is held in place with pins 100.7 extending through radial holes in the inner sleeve 100.4, lug 100.8, and upper 100.9 and lower 100.10 lug retainers. Longitudinal load is transferred from the roller screw nut 200.1 through the upper 100.9 and lower 100.10 lug retainers, and the lug 100.8 and pins 100.7 to the inner sleeve 100.4. The lug 100.8 also prevents rotation of the roller screw nut 200.1 by contacting the sides of the slot in the screw housing 300.2. The pins 100.7 are inserted through radial holes in the inner sleeve 100.4, lug 100.8, and upper 100.9 and lower 100.10 lug retainers, locking the components together to transfer longitudinal loads from the roller screw nut 200.1 to the upper 100.1 and lower 100.2 gripper assemblies. The upper end of pins 100.7 has external o-rings 100.99 in grooves which seal against the ID of radial holes through the inner sleeve 100.4.

Alternatively, it will be understood that the mechanical linkage subassembly 400 used in the inventive e-Tractor apparatus can be any type of assembly which will relay the linear force imparted by the linear actuator assembly of the inventive apparatus to the gripper assemblies 100.1 and 100.2 and other components as needed.

The power subassembly 200 contains the upper mandrel 200.10 which is made up to the upper end of the upper motor subassembly 200.11. The upper mandrel 200.10 ID contains power/control cable 200.7 and forms part of the fluid flow path 100.5 through the e-Tractor assembly 1000. The OD of the upper mandrel 200.10 is a sealing surface against which internal seals 200.12 in the upper gripper subassembly 100.1 seal. The annulus between the upper mandrel 200.10 OD and inner sleeve 100.4 ID form part of the fluid flow path through the e-Tractor assembly 1000. The upper motor subassembly 200.11 applies torque to the upper end of the roller screw shaft 300.1. The upper torque key 200.13 fits in aligned slots in the lower end of the upper motor housing 200.15, upper screw housing cap 300.3, and upper end of the screw housing 300.2, rotationally locking all three components together. Screws 200.14 are inserted through radial holes in the torque key 200.13 and made up in aligned radial threaded holes in the bottom of the slot in the upper screw housing cap 300.3 to hold the upper torque key 200.13 in place. The upper split ring shoulder 200.16 fits in an internal groove in upper end of the screw housing 300.2 and is retained in place by the upper split ring shoulder retainer 200.17. It provides an internal shoulder for the upper grooved roller bearing 300.4, preventing downward movement relative to the screw housing 300.2. The screw housing 300.2 has a longitudinal slot 300.2S through which the lug 100.8 in the tractor subassembly 100 extends, connecting the roller screw nut 200.1 to the tractor subassembly inner sleeve 100.4 made up on the OD of the power subassembly 200. The screw housing 300.2 also has an external slot extending its length in which the power/control cable 200.7 is assembled. The lower motor subassembly 200.18 applies torque to the lower end of the roller screw shaft 300.1. The lower split ring shoulder 200.19 fits in the internal groove in lower end of the screw housing 300.2 and is retained in place by the lower split ring shoulder retainer 200.20. It provides an internal shoulder for the lower grooved roller bearing 300.5, preventing downward movement relative to the screw housing 300.2. The lower torque key 200.21 fits in aligned slots in the upper end of the lower motor housing 200.31, lower screw housing cap 300.6, and lower end of the screw housing 300.2, rotationally locking all three components together. Screws 200.23 are inserted through radial holes in the torque key 200.21 and made up in aligned radial threaded holes in the bottom of the slot in the lower screw housing cap 300.6 to hold the lower torque key 200.21 in place. The pressure equalizing piston 300.7 is made up on the lower end of the lower actuator shoe 200.22 on the lower motor subassembly 200.18 and transfers hydraulic pressure in the e-Tractor assembly 1000 to the hydraulic oil 200.23 in the power subassembly 200. The pressure equalizing piston 300.7 has internal seals 300.8 that seal against the lower end of the lower actuator shoe 200.22 and external seals 300.9 that seal against the ID at the lower end of the inner sleeve 100.4. The lower mandrel split ring shoulder 200.24 fits in internal groove in upper end of lower mandrel 200.25 and is retained in place by the lower end of the lower actuator shoe 200.22 and provides an internal shoulder against which the lower actuator shoe 200.22 can be tightened. The lower mandrel 200.25 is made up to the lower end of the lower motor subassembly 200.18. The ID of the lower mandrel 200.25 contains the power/control cable 200.7 and forms part of the fluid flow path 100.5 through the e-Tractor. The OD of the lower mandrel 200.25 provides a sealing surface against which internal seal 100.11 in the lower gripper subassembly 100.2 seals against. The annulus between lower mandrel 200.25 OD and inner sleeve 100.4 ID form part of the fluid flow path 100.5 through the e-Tractor assembly 1000. The roller screw shaft subassembly 300 is made up in the screw housing 300.2 with the upper 200.11 and lower 200.18 motor subassemblies made up at each end. Torque is applied to each end of the roller screw shaft 300.1 by the motor subassemblies 200.11 and 200.18 generating a longitudinal force to the roller screw nut 200.1 in the tractor subassembly 100. The power/control cable 200.7 is run through the coiled tubing 6 from the surface A into and through the e-Tractor assembly 1000. The power/control cable 200.7 is connected to the upper 200.8 and lower 200.9 motor control electronics and is used to power and control the upper 200.3 and lower 200.4 motors.

Alternatively, it will be understood that the electro-mechanical linear actuator assembly used in the inventive e-Tractor apparatus can be any type of assembly which converts rotational motion provided by one or more DC or AC motors in the tool to linear motion for setting the one or more gripper assemblies 100.1 and/or 100.2 and/or pulling or pushing the run-in string longitudinally within the well casing or the borehole.

As seen in FIGS. 3-6 and as described above, in the embodiment of the inventive e-Tractor assembly 1000 depicted in FIG. 3, the inner body assembly 200.IB of the e-Tractor apparatus 1000 is longitudinally translatable within and relative to the outer housing 100.3 and preferably comprises: the upper mandrel 200.10, which is made up to the upper actuator shoe 200.26 of the upper motor sub-assembly 200.11, which is made up to the upper motor housing 200.15, which is made up to the upper screw housing cap 300.3, which is made up to the screw housing 300.2, which is made up to the lower screw housing cap 300.6, which is made up to the lower motor housing 200.31, which is made up to the lower actuator shoe 200.22 of the lower motor sub-assembly 200.18, which is made up to the lower mandrel 200.25.

The upper mandrel 200.10 provides an upper end segment of the inner body assembly 200.1B which projects from the upper end of the outer housing 100.3, the upper gripper assembly 100.1 being positioned on the upper mandrel 200.10 such that the upper mandrel 200.10 is longitudinally translatable through the upper gripper assembly 100.1. The lower mandrel 200.25 provides a lower end segment of the inner body assembly 200.1B which projects from the lower end of the outer housing 100.3, the lower gripper assembly 100.2 being positioned on the lower mandrel 200.25 such that the lower mandrel 200.25 is longitudinally translatable through the lower gripper assembly 100.2.

The upper motor subassembly 200.11 is comprised of the upper actuator shoe 200.26, upper motor control electronics 200.8, upper motor 200.3, upper gearhead 200.5, upper motor housing 200.15, upper battery 200.51 and the upper screw housing cap 300.3. The upper actuator shoe 200.26 is made up on the upper end of the upper motor housing 200.15 and has an ID bore through which the power/control cable 200.7 is run. An off-center hole runs the length of the upper actuator shoe 200.26 and is used to fill the center section of the power subassembly 200 with hydraulic oil 200.23. The upper end of the off-center hole has a pipe thread in which a pipe plug 200.50 is made up to contain the hydraulic oil 200.23. An external seal 200.28 at the upper end seals against the ID at the upper end of the inner sleeve 100.4. The upper motor control electronics 200.8 are used to control the upper motor 200.3 using power and control signals sent through the power/control cable 200.7. The upper battery 200.51 is used to provide a fail-safe means of releasing the grippers in the event cable power from the surface is lost such that retrieval and subsequent repair procedures are possible. The upper motor 200.3 is a DC motor used to apply torque to the upper gearhead 200.5. The upper gearhead 200.5 is used to reduce speed and increase torque that is applied to the upper end of the roller screw shaft 300.1. As depicted in FIG. 5, an upper gearhead output shaft 200.27 contains a torque key 200.28 to transfer torque from the upper gearhead 200.5 to an upper key coupling 200.29. The upper motor housing 200.15 is used to contain the upper motor 200.3, upper gearhead 200.5, and upper motor control electronics 200.8. The upper motor housing 200.15 has a radial hole and longitudinal external groove providing a path for the power/control cable 200.7. The upper motor housing 200.15 also has a radial slot at the lower end allowing it to be rotationally locked to the upper end of the upper screw housing cap 300.3. An internal upset at the lower end contains longitudinal holes through which cap screws 200.30 are inserted and made up in the upper gearhead

200.5. The upper screw housing cap 300.3 is made up in the lower end of the upper motor housing 200.15. The upper screw housing cap has a longitudinal slot that aligns with slots in the lower end of the upper motor housing 200.15 and upper end of the screw housing 300.2. The upper torque key 200.13 fits in the aligned slots and is held in place with torque key screws 200.14 made up through aligned radial holes in the upper torque key 200.13 and upper screw housing cap 300.3.

The lower motor subassembly 200.18 comprises the lower screw housing cap 300.6, lower motor housing 200.31, lower gearhead 200.6, lower motor 200.4, lower battery 200.52, lower motor control electronics 200.9, and lower actuator shoe 200.22. The lower screw housing cap 300.6 is made up in the upper end of the lower motor housing 200.31 and has a longitudinal slot that aligns with slots in the upper end of the lower motor housing 200.31 and lower end of the screw housing 300.2. The lower torque key 200.21 fits in the aligned slots and is held in place with torque key screws 200.40 made up through aligned radial holes in the torque key 200.21 and lower screw housing cap 300.3. The lower motor housing 200.31 is used to contain the lower motor 200.4, lower gearhead 200.6, and lower motor control electronics 200.9. The lower motor housing 200.31 has a radial hole and longitudinal external groove providing a path for the power/control cable 200.7. It also has a radial slot at the upper end allowing it to be rotationally locked to the lower end of the lower screw housing cap 300.6. An internal upset at the upper end contains longitudinal holes through which cap screws 20032 are inserted and made up in the lower gearhead 200.6. The lower gearhead 200.6 is used to reduce speed and increase torque applied to the lower end of the roller screw shaft 300.1. As depicted in FIG. 6, the lower gearhead output shaft 200.33 contains a torque key 200.34 to transfer torque from the lower gearhead 200.6 to the lower key coupling 200.35. The lower motor 200.4 is a bi-directional electric DC or AC motor used to apply torque to the lower gearhead 200.6. The lower motor control electronics 200.9 are used to control the lower motor 200.4 using power and control signals sent through the power/control cable 200.7. The lower actuator shoe 200.22 is made up on the lower end of the lower motor housing 200.31. The lower actuator shoe 200.22 has an ID bore through which the power/control 200.7 cable is run. An off-center hole runs the length of the lower actuator shoe 200.22 and provides a path for hydraulic oil 200.23. The lower end is elongated and provides an OD sealing surface on which the pressure equalizing piston 300.7 is assembled.

The roller screw shaft subassembly comprises the upper key coupling 200.29, the upper split ring shoulder 200.16 and retainer upper split ring shoulder retainer 200.20, upper grooved roller bearing 300.4, roller screw shaft 300.1, lower grooved roller bearing 300.5, and lower roller bearing spacer 300.10. As depicted in FIG. 5, the upper key coupling 200.29 has an internal slot into which keys 200.28 on the upper gearhead output shaft 200.27 and upper end of the roller screw shaft 300.1 are inserted to transfer torque from the upper gearhead 200.5 to the upper end of the roller screw shaft 300.1. The upper split ring shoulder 200.16 has multiple internal grooves which match multiple external grooves on the upper end of the roller screw shaft 300.1. The split ring shoulder 200.16 is fitted over the external grooves and the upper split ring shoulder retainer 200.17 is slipped over the upper split ring shoulder 200.16 to lock the shoulder in place on the roller screw shaft 300.1. The upper split ring shoulder 200.16 prevents upward movement of the upper grooved roller bearing relative to the roller screw shaft 300.1. The upper grooved roller bearing 300.4 is similar to a roller screw assembly except the rollers have multiple grooves instead of threads. The upper grooved roller bearing 300.4 transfers longitudinal loads between the roller screw shaft 300.1 and the screw housing 300.2 through the upper split ring shoulder retainer 200.17 and upper split ring shoulder 200.16. The roller screw shaft 300.1 contains external keys 200.28/200.34 at each end to transfer torque from the upper 200.5 and lower 200.6 gearheads. Multiple external grooves at each end allow the fitting of external split ring shoulders 200.16/200.19 and retainers 200.17/200.20 that prevent upward movement of the upper grooved roller bearing 300.4 and downward movement of the lower grooved roller bearing 300.5 relative to the roller screw shaft 300.1. The center of the roller screw shaft 300.1 contains an external roller screw thread that matches the threads on mating roller screw bearings within roller screw nut 200.1. The lower end of the roller screw shaft 300.1 is machined to the root diameter of the roller screw thread to allow assembly of the roller screw nut 200.1. The lower grooved roller bearing 300.5 is similar to a roller screw assembly except the rollers have multiple grooves instead of threads. The lower grooved roller bearing transfers longitudinal loads between the roller screw shaft 300.1 and screw housing 300.2 through the lower split ring shoulder 200.19 and the screw housing 300.2. The lower roller bearing spacer 300.10 is made up between the lower grooved roller bearing 300.5 ID and lower end of the roller screw shaft 300.1. The lower split ring shoulder 200.19 has multiple internal grooves which match multiple external grooves on the lower end of the roller screw shaft 300.1. The lower split ring shoulder 200.19 is fitted over the external grooves and the lower split ring shoulder retainer 200.20 is slipped over the shoulder 200.19 to lock the shoulder in place on the roller screw shaft 300.1. The lower split ring shoulder 200.19 prevents downward movement of the lower grooved roller bearing 300.5 relative to the roller screw shaft 300.1. The lower key coupling 200.35 has an internal slot into which keys 200.34 on the lower gearhead output shaft 200.33 and lower end of the roller screw shaft 300.1 are inserted to transfer torque from the lower gearhead 200.6 to the lower end of the roller screw shaft 300.1.

In operation, the e-Tractor 1000 is run into the wellbore 1 with the upper 100.1 and lower 100.2 gripper assemblies collapsed to avoid contacting the casing 4 ID. Once the e-Tractor 1000 is in position, control signals and electric power are applied to the upper 200.3 and lower 200.4 motors through the power/control cable 200.7 and motor control electronics 200.8 and 200.9. The upper 200.3 and lower 200.4 motors will rotate in opposite directions at the same rpm to apply right hand torque to the roller screw shaft 300.1 through the upper 200.5 and lower 200.6 gearheads. Right hand rotation of the roller screw shaft 300.1 will apply an upward longitudinal load to the roller screw nut 200.1 which is transferred to the upper 100.9 and lower 100.10 lug retainers, pins 100.7, lug 100.8, and inner sleeve 100.4. The upward load is then transferred through the inner sleeve 100.4 to the upper grippers 100.GU in the upper gripper subassembly 100.1 and the outer sleeve 100.3. This movement and load is used to set the lower grippers 100.GL in the lower gripper subassembly 100.2 against the casing 4 ID. Once the lower grippers 100.GL are set, the load then starts pulling the power subassembly 200 and coiled tubing 6 distally downhole. At the end of the stroke, rotation of the upper 200.3 and lower 200.4 DC motors, upper 200.5 and lower 200.6 gearheads and roller screw shaft 300.1 is reversed, moving the roller screw nut 200.1, upper 100.9 and lower 100.10 lug retainers, lug 100.8, pins 100.7, inner sleeve 100.4, upper gripper subassembly 100.1, and outer sleeve 100.3 downward. This movement and load unsets the lower grippers 100.GL in the lower gripper subassembly 100.2 and repositions the tractor subassembly 100 back to its original position and ready for another stroke. In this operation, the grippers 100.GU in the upper gripper subassembly 100.1 have remained retracted.

Stroke length and position of the tractor subassembly 100 relative to the power subassembly 200 is determined by the electronics 200.8/200.9 counting the motor 200.3/200.4 revolutions. This leads to the gearhead 200.5/200.6 output and roller screw shaft 300.1 revolutions from which longitudinal movement of the roller screw nut 200.1 can be determined.

To push the coiled tubing 6 proximally (uphole) within wellbore 1, the above sequence is reversed with the grippers 100.GU in the upper gripper subassembly 100.1 being set and unset and the grippers 100.GL in the lower slip subassembly 100.2 remaining retracted.

This operation, which utilizes a single e-Tractor assembly 1000, will generate start-stop, intermittent movement of the coiled tubing 6. Continuous movement of the coiled tubing 6 can be achieved by using two e-Tractors 1000 so that the first e-Tractor 1000 is applying a longitudinal force and thereby movement of the CT 6, while the second e-Tractor 1000 is resetting. As the e-Tractor assembly 1000 nears the end of its stroke and is slowing down, the second e-Tractor assembly 1000 is beginning its stroke and speeding up.

Increasing the amount of longitudinal force available for CT movement in a continuous motion mode can be achieved by using a series of three or more e-Tractors. Likewise, the e-Tractors 1000 in a multi-assembly configuration can be switched to intermittent mode to utilize the pulling capacity of all the e-Tractors 1000 simultaneously. Continuous motion mode requires one e-Tractor assembly 1000 to be in its respective resetting sequence at all times to provide the continuous movement.

The power subassembly 200 comprising the motor control electronics 200.8/200.9, motors 200.3/200.4, gearheads 200.5/200.6, roller screw shaft 300.1 and components of the tractor subassembly 100 in the inner sleeve 100.4 ID is filled with hydraulic oil 200.23 for lubricating and cooling the components. As hydrostatic and circulating pressure in the e-Tractor assembly 1000 ID increases, the pressures act on the lower end of the pressure equalizing piston 300.7 at the lower end of the lower motor subassembly 200.18 and move the equalizing piston 300.7 upward until the pressure of the hydraulic oil 200.23 is equal to that of the e-Tractor assembly 1000 ID. The equalizing piston 300.7 therefore eliminates the differential pressure across the internal 300.8 and external 300.9 seals that separate the hydraulic oil 300.7 from circulating fluid in the fluid flow path 100.5 of the e-Tractor 1000. The inner sleeve 100.4 ID-power subassembly 200 OD annulus encapsulated between the external seals 200.28/300.9 at each end of the power subassembly 200, the annulus between the DC motors 200.3/200.4 and gearheads 200.5/200.6 OD and motor housings 200.15/200.31 ID, holes and slots in the power subassembly 200 components allow for hydraulic oil 200.23 movement and pressure equalization in the power subassembly 200.

Thus, the present invention is well adapted to carry out the objectives and attain the ends and advantages mentioned above as well as those inherent therein. While presently preferred embodiments have been described for purposes of this disclosure, numerous changes and modifications will be apparent to those in the art. Such changes and modifications are encompassed within this invention as defined by the claims.

What is claimed is:

1. An electric motor-actuated tractor (e-Tractor) apparatus for use in a wellbore comprising:

a longitudinally extending inner body assembly;

a gripper assembly movable between (i) a retracted position and (ii) an outward gripping position for engaging an inner surface in the wellbore;

a linear actuator subassembly, in the inner body assembly, comprising a longitudinally extending screw, at least one bi-directional electric motor which is directly or indirectly coupled to an end of the screw, and a nut which is positioned on the screw, the nut being locked against rotation; and the rotation of the screw by the at least one bi-directional electric motor in a first rotational direction when using the e-Tractor apparatus in the wellbore causes the nut to move in a first longitudinal direction with respect to the inner body assembly which causes the gripper assembly to move from its retracted position to its outward gripping position and then, with the gripper assembly in its outward gripping position, the continued rotation of the screw by the at least one bi-directional electric motor in the first rotational direction pulls or pushes the inner body assembly in a second longitudinal direction, opposite the first longitudinal direction, with respect to the gripper assembly.

2. The e-Tractor apparatus of claim 1 comprising:

the at least one bi-directional electric motor being a first bi-directional electric motor;

the end of the screw being a first end of the screw; and the linear actuator subassembly further comprising a second bi-directional electric motor in the inner body assembly which is directly or indirectly coupled to a second end of the screw opposite the first end of the screw.

3. The e-Tractor apparatus of claim 2 further comprising the linear actuator subassembly including:

a first motor control electronics unit, within the inner body assembly, which is electronically connected to the first bi-directional electric motor;

a second motor control electronics unit, within the inner body assembly, which is electronically connected to the second bi-directional electric motor; and the first and second motor control electronics units operating the first and second bi-directional electric motors in synchronization in opposite rotational directions at identical speeds for rotating the screw.

4. The e-Tractor apparatus of claim 3 further comprising the linear actuator subassembly including:

a first battery, within the inner body assembly, which is electrically connected to the first bi-directional electric motor for at least temporarily powering the first bi-directional electric motor and a second battery, within the inner body assembly, which is electrically connected to the second bi-directional electric motor for at least temporarily powering the second bi-directional electric motor.

5. The e-Tractor apparatus of claim 1 further comprising:

a longitudinally extending outer housing having a first end and a second end;

the inner body assembly being longitudinally translatable within and relative to the outer housing, the inner body assembly including an end segment which projects from the first end of the outer housing; and the gripper assembly being positioned on the end segment of the inner body assembly, the end segment being longitudinally translatable through the gripper assembly, and at least a portion of the gripper assembly being connected or linked to the outer housing for moving the gripper assembly between its retracted position and its outward gripping position.

6. The e-Tractor apparatus of claim 5 further comprising:

an inner sleeve which is positioned within the outer housing and outside of the inner body assembly;

a mechanical linkage, between the nut and the inner sleeve, which extends through a slot in the inner body assembly; and a carrying structure for the outer housing which is engaged by the inner sleeve to move the outer housing longitudinally with respect to the inner body assembly to move the gripper assembly to the outward gripping position.

7. The e-Tractor apparatus of claim 6 further comprising the mechanical linkage comprising:

a lug;

a pair of lug retainers which retain the lug on the nut; and a plurality of pins which extend through the lug retainers and the lug to the inner sleeve.

8. The e-Tractor apparatus of claim 6 further comprising:

the movement of the nut in the first longitudinal direction with respect to the inner body assembly carries the inner sleeve, outside of and with respect to the inner body assembly, in the first longitudinal direction into engagement with the carrying structure for the outer housing so that the inner sleeve also moves the outer housing in the first longitudinal direction with respect to the inner body assembly;

the movement of the outer housing in the first longitudinal direction moves the gripper assembly to its outward gripping position; and the movement of the gripper assembly to its outward gripping position in the wellbore stops the movement of the nut, the inner sleeve, and the outer housing in the first longitudinal direction relative to the wellbore so that the continued rotation of the screw by the at least one bi-directional electric motor in the first rotational direction will pull or push the inner body within and relative to the inner sleeve, and within and relative to the outer housing, in the second longitudinal direction.

9. The e-Tractor apparatus of claim 1 further comprising:

the gripper assembly being a first gripper assembly;

the e-Tractor apparatus further comprising a second gripper assembly movable between (i) a retracted position and (ii) an outward gripping position for engaging the inner surface in the wellbore;

when the first gripper assembly is in its outward gripping position in the wellbore and the at least one bi-directional electric motor rotates the screw in a second rotational direction opposite the first rotational direction, the rotation of the screw in the second rotational direction causes the nut to move in the second longitudinal direction with respect to the inner body assembly to move the first gripper assembly from its outward gripping position to its retracted position; and with each of the first and the second gripper assemblies in its retracted position, rotation of the screw in the second rotational direction causes the nut to move in the second longitudinal direction which causes the second gripper assembly to move from its retracted position to its outward gripping position, and then, as the at least one bi-directional electric motor continues to rotate the screw in the second rotational direction with the second gripper assembly in its outward gripping position, the continued rotation of the screw in the second rotational direction pulls or pushes the inner body assembly in the first longitudinal direction with respect to the second gripper assembly.

10. The e-Tractor apparatus of claim 9 further comprising:

a longitudinally extending outer housing having a first end and a second end;

the inner body assembly being longitudinally translatable within and relative to the outer housing, the inner body assembly including a first end segment which projects from the first end of the outer housing and a second end segment which projects from the second end of the outer housing;

the first gripper assembly being positioned on the first end segment of the inner body assembly, the first end segment being longitudinally translatable through the first gripper assembly, and at least a portion of the first gripper assembly being connected or linked to the outer housing for moving the first gripper assembly between its retracted position and its outward gripping position: and the second gripper assembly being positioned on the second end segment of the inner body assembly, the second end segment being longitudinally translatable through the second gripper assembly, and at least a portion of the second gripper assembly being connected or linked to the outer housing for moving the second gripper assembly between its retracted position and its outward gripping position.

11. The e-Tractor apparatus of claim 10 further comprising:

an inner sleeve which is positioned within the outer housing and outside of the inner body assembly;

a mechanical linkage, between the nut and the inner sleeve, which extends through a slot in the inner body assembly;

a first carrying structure for the outer housing which is engaged by the inner sleeve to move the outer housing in the first longitudinal direction with respect to the inner body assembly to move the first gripper assembly to its outward gripping position; and a second carrying structure for the outer housing which is engaged by the inner sleeve to move the outer housing in the second longitudinal direction with respect to the inner body assembly to move the second gripper assembly to its outward gripping position.

12. The e-Tractor apparatus of claim 11 further comprising:

the movement of the nut in the first longitudinal direction with respect to the inner body assembly carries the inner sleeve, outside of and with respect to the inner body assembly, in the first longitudinal direction into engagement with the first carrying structure for the outer housing so that the inner sleeve also moves the outer housing in the first longitudinal direction with respect to the inner body assembly;

the movement of the outer housing in the first longitudinal direction moves the first gripper assembly to its outward gripping position;

the movement of the first gripper assembly to its gripping position in the wellbore stops the movement of the nut, the inner sleeve, and the outer housing in the first longitudinal direction relative to the wellbore so that the continued rotation of the screw by the at least one bi-directional electric motor in the first rotational direction will pull or push the inner body assembly within and relative to the inner sleeve, and within and relative to the outer housing, in the second longitudinal direction;

the movement of the nut in a second longitudinal direction with respect to the inner body assembly carries the inner sleeve, outside of and with respect to the inner body assembly, in the second longitudinal direction into engagement with the second carrying structure for the outer housing so that the inner sleeve also moves the outer housing in the second longitudinal direction with respect to the inner body assembly;

the movement of the outer housing in the second longitudinal direction moves the second gripper assembly to its outward gripping position; and the movement of the second gripper assembly to its outward gripping position in the wellbore stops the movement of the nut, the inner sleeve, and the outer housing in the second longitudinal direction relative to the wellbore so that the continued rotation of the screw by the at least one bi-directional electric motor in the second rotational direction will pull or push the inner body within and relative to the inner sleeve, and within and relative to the outer housing, in the first longitudinal direction.

13. The e-Tractor apparatus of claim 11 further comprising:

the first end segment of the inner body assembly being a first mandrel which projects from the first end of the outer housing and extends through the first gripper assembly;

the second end segment of the inner body assembly being a second mandrel which projects from the second end of the outer housing and extends through the second gripper assembly; and the inner body assembly also includes a screw housing in which the screw is rotatably positioned, the screw housing having the slot formed therein through which the mechanical linkage extends.

14. The e-Tractor apparatus of claim 11 further comprising:

the second gripper assembly comprising a second gripper sub which is connected to the second end of the outer housing;

the second gripper sub including the first carrying structure for the outer housing the first carrying structure being engaged by a second end of the inner sleeve;

the first gripper assembly comprising a first gripper sub which is connected to the first end of the outer housing; and the first gripper sub including the second carrying structure for the outer housing, the second carrying structure being engaged by a first end of the inner sleeve, the second end of the inner sleeve being opposite the first end of the inner sleeve.

15. The e-Tractor apparatus of claim 1 further comprising at least one sensor for real-time sensing which senses or measures a pressure, a temperature, a load, a stress, a tension, a position of the e-Tractor apparatus or of a component thereof, an orientation of the e-Tractor apparatus or of a component thereof, or a combination thereof.

16. The e-Tractor apparatus of claim 1 wherein the inner surface in the wellbore is an inner surface of a casing installed in the wellbore.

17. The e-Tractor apparatus of claim 1 wherein the inner surface in the wellbore is an interior wall of a borehole.

18. A downhole apparatus for use in a wellbore comprising:

a run-in string and one or more electric motor-actuated tractor (e-Tractor) apparatuses, each of the one or more e-Tractor apparatuses comprising a longitudinally extending inner body assembly having an end which is connected or linked to the run-in string, a gripper assembly movable between (i) a retracted position and (ii) an outward gripping position for engaging an inner surface in the wellbore, a linear actuator subassembly, in the inner body assembly, comprising a longitudinally extending screw, at least one bi-directional electric motor which is directly or indirectly coupled to an end of the screw, and a nut which is positioned on the screw, the nut being locked against rotation, and a motor control which is electronically connected to the at least one bi-directional motor, the motor control being operable to control the at least one bi-directional motor to rotate the screw in a first rotational direction, in a first stage of operation, which causes the nut to move in a first longitudinal direction with respect to the inner body assembly which moves the gripper assembly from its retracted position to its outward gripping position at a first setting location in the wellbore, and then continue to rotate the screw in the first rotational direction, in a tractoring stage of operation, with the gripper assembly in its outward gripping position, which pulls or pushes the inner body assembly and the run-in string in a second longitudinal direction, opposite the first longitudinal direction, with respect to the gripper assembly, and then rotate the screw in a second rotational direction opposite the first rotational direction, in a third stage of operation, which causes the nut to move in the second longitudinal direction with respect to the inner body assembly to a point for releasing the gripper assembly, and then continue to rotate the screw in the second rotational direction, in a fourth stage of operation, which causes the nut to continue to move in the second longitudinal direction with respect to the inner body assembly to release the gripper assembly and then move the gripper assembly in the second longitudinal direction to a next setting location in the wellbore.

19. The downhole apparatus of claim 18 further comprising:

the downhole apparatus comprising a plurality of the e-Tractor apparatuses and the motor controls of the plurality of the e-Tractor apparatuses being operable for operating the e-Tractor apparatuses together in a continuous tractoring mode in which whenever any of the e-Tractor apparatuses is operating in any of the first, the third, or the fourth stage of operation, at least one other of the e-Tractor apparatuses will be operating in the tractoring stage of operation.

20. The downhole apparatus of claim 19 further comprising the motor controls of the plurality of the e-Tractor apparatuses being operable for changing from the continuous tractoring mode to an intermittent tractoring mode in which all of the e-Tractor apparatuses operate simultaneously, in unison, in each of the first, the tractoring, the third, and the fourth stages of operation.

21. The downhole apparatus of claim 19 further comprising the motor controls of the plurality of the e-Tractor apparatuses operating the at least one bi-directional electric motor of each of the e-Tractor apparatuses at a higher rotational speed in the first, the third, and/or the fourth stage of operation than in the tractoring stage of operation.

22. The downhole apparatus of claim 18 further comprising the run-in string comprising a coiled tubing, an c-coil, a cable, or a wireline.

23. The downhole apparatus of claim 18 further comprising the run-in string having an electric cable, an electric wireline, a fiberoptic cable, or a combination thereof which extends through or is incorporated in the run-in string.

24. The downhole apparatus of claim 18 further comprising each of the one or more e-Tractor apparatuses having a fluid passageway for delivering a fluid therethrough.

25. The downhole apparatus of claim 18 further comprising each of the one or more e-Tractor apparatuses also comprising:

a longitudinally extending outer housing having a first end and a second end;

the inner body assembly being longitudinally translatable within and relative to the outer housing, the inner body assembly including an end segment which projects from the first end of the outer housing;

the gripper assembly being positioned on the end segment of the inner body assembly, the end segment being longitudinally translatable through the gripper assembly, and at least a portion of the gripper assembly being connected or linked to the outer housing for moving the gripper assembly between its retracted position and its outward gripping position;

an inner sleeve which is positioned within the outer housing and outside of the inner body assembly;

a mechanical linkage, between the nut and the inner sleeve, which extends through a slot in the inner body assembly; and a carrying structure for the outer housing which is engaged by the inner sleeve to move the outer housing longitudinally with respect to the inner body assembly to move the gripper assembly to the outward gripping position.

26. A method of moving a run-in string longitudinally in a wellbore, the method comprising the steps of:

a) providing a plurality of electric motor-actuated tractor (e-Tractor) apparatuses, each of the plurality of the e-Tractor apparatuses being connected or linked to the run-in, and each of the plurality of the e-Tractor apparatuses comprising a gripper assembly and at least one bi-directional electric motor which is operated to turn a screw in the e-Tractor apparatus to cause the e-Tractor apparatus to repeatedly (1) perform a first operation in which the gripper assembly is moved from a retracted position to an outward gripping position in contact with an inner surface in the wellbore at a first location in the wellbore, and then (2) perform a tractoring operation which pulls or pushes the run-in string in a first longitudinal direction in the wellbore, and then (3) perform a third operation which includes retracting the gripper assembly from its outward gripping position to its retracted position, and then (4) perform a fourth operation in which the gripper assembly is moved in the first longitudinal direction from the first location to a next setting location in the wellbore and b) operating the plurality of the e-Tractor apparatuses in a continuous tractoring mode in which whenever any one of the e-Tractor apparatuses is performing any of the first, the third, or the fourth operations, at least one other of the plurality of the e-Tractor apparatus is performing the tractoring operation.

27. The method of claim 26 further comprising changing the plurality of the e-Tractor apparatuses from operating in the continuous tractoring mode to operating in an intermittent tractoring mode in which all of the e-Tractor apparatuses simultaneously perform each of the first, the tractoring, the third, and the fourth operations in unison.

28. The method of claim 26 further comprising operating the at least one bi-directional electric motor of each of the e-Tractor apparatuses at a higher rotational speed when performing the first, the third, and/or the fourth operation than when performing the tractoring operation.

29. A method of moving a run-in string longitudinally in a horizontal or deviated wellbore, the method comprising the steps of:

a) providing at least one electric motor-actuated tractor (e-Tractor) apparatus, which is connected or linked to the run-in string, the at least one e-Tractor apparatus comprising a gripper assembly, a rotatable, longitudinally extending screw in the e-Tractor apparatus, a nut which is positioned on the screw and locked against rotation to translate a rotation of the screw to a linear movement of the nut on the screw, and at least one bi-directional electric motor for rotating the screw and b) operating the at least one bi-directional electric motor to turn the screw so that the nut is moved linearly on the screw to cause the e-Tractor apparatus to repeatedly (1) perform a first operation in which the gripper assembly is moved from a retracted position to an outward gripping position in contact with an inner surface of the horizontal or deviated wellbore at a first location in the horizontal or deviated wellbore, and then (2) perform a tractoring operation which pulls or pushes the run-in string in a first longitudinal direction in the horizontal or deviated wellbore, and then (3) perform a third operation which includes retracting the gripper assembly from its outward gripping position to its retracted position, and then (4) perform a fourth operation in which the gripper assembly is moved in the first longitudinal direction from the first location to a next setting location in the horizontal or deviated wellbore.

30. The method of claim 29 further comprising moving the run-in string in the horizontal or deviated wellbore using only the tractoring operation of the at least one e-Tractor apparatus to pull or push the run-in string without using surface injection, applied hydraulic pressure, or vibration or agitation techniques.

* * * * *